US006693609B2

(12) United States Patent
Lee et al.

(10) Patent No.: US 6,693,609 B2
(45) Date of Patent: Feb. 17, 2004

(54) METHOD OF GENERATING OPTIMAL PATTERN OF LIGHT EMISSION AND METHOD OF MEASURING CONTOUR NOISE AND METHOD OF SELECTING GRAY SCALE FOR PLASMA DISPLAY PANEL

(75) Inventors: Nam Kyu Lee, Kumi-shi (KR); Bon Cheol Koo, Taegu-shi (KR); Ki Sang Hong, Pohang-shi (KR); Jae Woo Kim, Seoul (KR); Yong Duek Kim, Taegu-shi (KR); Seong Ho Kang, Taegu-shi (KR)

(73) Assignee: LG Electronics Inc., Seoul (KR)

( * ) Notice: Subject to any disclaimer, the term of this patent is extended or adjusted under 35 U.S.C. 154(b) by 93 days.

(21) Appl. No.: 10/001,926

(22) Filed: Dec. 5, 2001

(65) Prior Publication Data

US 2002/0158819 A1 Oct. 31, 2002

(30) Foreign Application Priority Data

Dec. 5, 2000 (KR) ..... P2000-73175
Dec. 6, 2000 (KR) ..... P2000-73814
Dec. 3, 2001 (KR) ..... P2001-76008

(51) Int. Cl.[7] ..... G09G 3/28
(52) U.S. Cl. ..... 345/63

(58) Field of Search ..... 345/60, 63, 148, 345/147; 315/169.1, 169.4

(56) References Cited

U.S. PATENT DOCUMENTS 6,100,939 A * 8/2000 Kougami et al. ..... 348/687
6,340,867 B1 * 1/2002 Kang ..... 315/169.4
6,414,657 B1 * 7/2002 Kasahara et al. ..... 345/63
6,429,833 B1 * 8/2002 Ryeom et al. ..... 345/63
6,433,763 B1 * 8/2002 Lim et al. ..... 345/68
6,466,187 B1 * 10/2002 Moon ..... 345/63
6,473,061 B1 * 10/2002 Lim et al. ..... 345/60

FOREIGN PATENT DOCUMENTS

EP 107 069 A2 * 1/2001 ..... G09G/3/28

* cited by examiner

*Primary Examiner*—Amare Mengistu
(74) *Attorney, Agent, or Firm*—Fleshner & Kim, LLP

(57) ABSTRACT

An optimal light-emission pattern generation method for a plasma display panel according to an embodiment of the present invention includes steps of determining a plurality of light-emission patterns with respect to an arbitrary gray level; calculating a contour noise degree between a contour noise free gray level being set in advance and the light-emission patterns given to each gray level in plurality; and selecting a light-emission pattern whose contour noise degree is minimal as a light-emission pattern with respect to an arbitrary gray level.

20 Claims, 25 Drawing Sheets

FIG.9

GRAY LEVEL 62

| # | LIGHT-EMISSION PATTERN |
|---|---|
| 1 | 000010011011 |
| 2 | 100100001011 |
| 3 | 000010110011 |
| 4 | 100100100011 |
| 5 | 010010011001 |
| 6 | 110100001001 |
| 7 | 010010110001 |
| 8 | 110100100001 |
| 9 | 000000010110 |
| 10 | 110010000110 |
| 11 | 001000010010 |
| 12 | 100011000010 |
| 13 | 111010000010 |
| 14 | 010000010100 |
| 15 | 000000101000 |
| 16 | 000001010000 |
| 17 | 011000010000 |
| 18 | 110011000000 |

GRAY LEVEL 124

| # | LIGHT-EMISSION PATTERN |
|---|---|
| 1 | 110100011111 |
| 2 | 101000001111 |
| 3 | 110100110111 |
| 4 | 101000100111 |
| 5 | 010101000111 |
| 6 | 100101011011 |
| 7 | 111100011011 |
| 8 | 100101110011 |
| 9 | 111100110011 |
| 10 | 011101000011 |
| 11 | 100001001101 |
| 12 | 111000001101 |
| 13 | 100001100101 |
| 14 | 111000100101 |
| 15 | 110101011001 |
| 16 | 101001001001 |
| 17 | 110101110001 |
| 18 | 101001100001 |
| 19 | 000000111110 |
| 20 | 110010101110 |
| 21 | 110011010110 |
| 23 | 001110000110 |
| 24 | 001000111010 |
| 25 | 100011101010 |
| 26 | 111010101010 |
| 27 | 111011010010 |
| 28 | 010000111100 |
| 29 | 100110011100 |
| 30 | 100110110100 |
| 31 | 000111000100 |
| 32 | 011110000100 |
| 33 | 000001111000 |
| 14 | 011000111000 |
| 34 | 101110011000 |
| 35 | 110011101000 |
| 36 | 101110110000 |
| 37 | 001111000000 |

GRAY LEVEL 202

| # | LIGHT-EMISSION PATTERN |
|---|---|
| 1 | 110101111111 |
| 2 | 101001101111 |
| 3 | 111101111011 |
| 4 | 111001101101 |
| 5 | 101110111110 |
| 6 | 001111001110 |
| 7 | 001111100110 |
| 8 | 100111111100 |
| 9 | 111110111100 |
| 10 | 011111001100 |
| 11 | 011111100100 |
| 12 | 101111111000 |

| | INVENTION | VDP |
|---|---|---|
| 1 | 68.65 | 2.276 |
| 2 | 82.58 | 2.456 |
| 3 | 90.06 | 4.017 |
| 4 | 121.95 | 3.356 |
| 5 | 128 | 5.903 |
| 6 | 162.66 | 9.001 |

FIG.18

| ITEM | SUB-FIELD ARRAY | | ITEM | SUB-FIELD ARRAY |
|---|---|---|---|---|
| 0 | 9 34 7 13 48 2 33 34 22 48 1 4 | | 16 | 48 34 9 4 22 48 13 34 7 33 2 1 |
| 1 | 1 48 34 13 48 9 7 34 22 33 4 2 | | 17 | 1 2 34 9 34 48 48 13 22 33 4 7 |
| 2 | 4 13 22 9 34 48 33 48 34 7 1 2 | | 18 | 13 33 48 9 7 48 22 34 2 34 1 4 |
| 3 | 1 4 22 48 34 13 48 34 7 33 9 2 | | 19 | 2 1 7 48 22 34 34 4 13 48 33 9 |
| 4 | 1 48 34 13 33 48 7 34 22 9 4 2 | | 20 | 4 9 33 48 22 48 34 7 13 34 1 2 |
| 5 | 48 33 4 9 1 34 22 34 48 7 13 2 | | 21 | 2 4 34 1 34 22 48 7 13 48 33 9 |
| 6 | 2 22 34 1 34 4 48 7 13 48 33 9 | | 22 | 4 22 9 33 34 1 7 48 13 34 48 2 |
| 7 | 34 13 1 33 7 48 22 48 4 2 9 34 | | 23 | 4 34 13 34 9 48 33 7 22 48 1 2 |
| 8 | 7 22 13 34 48 1 2 4 33 48 34 9 | | 24 | 2 1 7 48 22 48 34 4 13 34 33 9 |
| 9 | 34 7 1 2 4 48 22 48 9 13 33 34 | | 25 | 1 9 22 48 34 13 48 7 34 33 4 2 |
| 10 | 1 48 34 13 48 22 7 34 33 9 4 2 | | 26 | 2 34 9 22 48 7 1 33 48 34 13 4 |
| 11 | 7 2 1 33 13 34 48 34 9 48 22 4 | | 27 | 2 22 1 33 7 13 48 34 48 34 9 4 |
| 12 | 34 13 33 9 34 4 1 48 22 48 7 2 | | 28 | 1 7 13 48 33 34 34 9 48 22 4 8 |
| 13 | 1 22 48 7 34 48 13 34 33 9 4 2 | | 29 | 4 22 9 33 34 2 7 48 13 34 48 1 |
| 14 | 1 13 33 48 34 7 48 22 34 9 4 2 | | 30 | 13 33 48 9 2 48 22 4 1 7 34 34 |
| 15 | 2 13 7 48 22 48 1 4 34 34 33 9 | | 31 | 1 22 13 7 48 48 34 9 34 33 4 2 |

12 SUB-FIELD

11 SUB-FIELD

10 SUB-FIELD

METHOD OF GENERATING OPTIMAL PATTERN OF LIGHT EMISSION AND METHOD OF MEASURING CONTOUR NOISE AND METHOD OF SELECTING GRAY SCALE FOR PLASMA DISPLAY PANEL

BACKGROUND OF THE INVENTION

1. Field of the Invention

This invention relates to a driving method and apparatus for a plasma display panel, and more particularly to a method of generating an optimal light-emission pattern for a plasma display panel in order to select a light-emission pattern where a moving picture pseudo contour noise is minimized. Also it relates to a method of measuring a contour noise for a plasma display panel in order to rapidly calculate a contour noise degree and a method of selecting a gray scale in order to select a sub-field array and a gray scale with which the contour noise is minimized.

2. Description of the Related Art

Generally, a plasma display panel (PDP) makes a fluorescent body radiate by using an ultraviolet with a wavelength of 147 nm generated upon discharge of an inactive mixture gas such as He+Xe, Ne+Xe or He+Ne+Xe gas, to thereby display a picture including characters and graphics. Such a PDP is easy to be made into a thin-film and large-dimension type. Moreover, the PDP provides a very improved picture quality owing to a recent technical development.

Referring to FIG. 1, a discharge cell of a three-electrode, AC surface-discharge PDP includes a scanning/sustaining electrode Y and a common sustaining electrode Z provided on an upper substrate 1, and an address electrode X provided on a lower substrate 4.

The address electrode X perpendicularly cross a sustaining electrode pair including one scanning/sustaining electrode Y and one common sustaining electrode Z. On the upper substrate 1, a dielectric layer 2 and a protective film 3 are disposed in such a manner to cover the scanning/sustaining electrode Y and the common sustaining electrode Z. A dielectric layer 5 is entirely deposited onto the lower substrate 4 in such a manner to cover the address electrode X, a barrier rib 6 is provided thereon in a direction parallel to the address electrode X. A discharge such as an inactive mixture gas is injected into a discharge space defined between the upper/lower substrate 1 and 4 and the barrier rib 6.

In such a PDP, for implementing a gray level of a picture, one frame is divided into a plurality of sub-fields, each of which a brightness weighting value is given to, so as to be driven in a manner of time division. A sub-field array is defined as a set of a plurality of sub-fields which are included within one frame interval. Each sub-field included in the sub-field array is again divided into a reset interval or setup interval for initializing cells of the entire screen, an address interval for selecting cells and a sustaining interval determined in proportion to the brightness weighting value where a discharge frequency is set in advance.

FIG. 2 represents an eight bit default code including 8 sub-fields corresponding to each bit of eight bits in a sub-field array. In the eight bit default code, eight sub-fields each has the brightness weighting value increased in the order from a least significant bit to a most significant bit by $2^n$ (wherein n=0, 1, 2, 3, 4, 5, 6 and 7) to be capable of expressing 256 gray levels.

The PDP may generate a pseudo contour noise from a moving picture because of its characteristic of implementing a gray scale of a picture by a combination of sub-fields. Hereinafter, such a moving picture pseudo contour noise is referred briefly to as a 'contour noise'. If the contour noise is generated, then a pseudo contour emerges on the screen to deteriorate a display quality of moving picture. For instance, when the screen is moved to the right at a speed of 1 pixel/frame after the left half of the screen was displayed by a gray level value '127' and the right half of the screen was displayed by a gray level value '128' as shown in FIG. 3 and FIG. 4, an eye of an observer follows such a motion of the screen to simultaneously view lights irradiated from the adjacent two pixels. Since light-emissions from the two pixels each displaying gray levels '127' and '128' are accumulated at an interface between gray levels, the eye views the two pixels more brightly rather than recognizing a real brightness of the two pixels respectively. In other words, the eye views a peak white, that is, a white band emitted more brightly than the other area from the two pixels emitted by the gray levels of '127' and '128'. On the contrary, if the screen, the left half of which is displayed by the gray level value '128' and the right half of which is displayed by the gray level value '127', is moved to the right, then a black band emerges from a boundary portion between gray level values '127' and '128'.

Strategies for eliminating such a contour noise include a scheme of dividing one sub-field to add 1 or 2 sub-fields for increasing the total number of sub-fields, a scheme of re-arranging a sequence of sub-fields, a scheme of adding sub-fields and re-arranging a sequence of sub-fields, and etc. Further, they include a scheme of carrying out an error diffusion method together with any one of the above-mentioned schemes. However, since said addition of sub-fields causes a lack of an address interval or a sustaining interval, there is raised a problem that a screen becomes dark.

An example of said scheme of re-arranging sub-fields is a scheme of arranging sub-fields at a sequence of brightness weighting values '1, 2, 4, 8, 16, 64, 32, 64, which was suggested in U.S. Pat. No. 6,100,939. Other example is a scheme of randomly arranging a sequence of sub-fields for each frame in accordance with an input image signal, which was suggested in Japanese Laid-open Gazette No. Pyung 7-27135. Such schemes of re-arranging a sequence of sub-fields are capable of reducing the contour noise to a certain degree. However, since it is virtually impossible for such schemes to meet all events at which any contour noise is generated because the contour noise appears in various types in accordance with an input image signal, such schemes have a limit that a contour noise reduction effect fails to reach to a desired level.

Recently, in order to eliminate a moving picture pseudo contour noise, there has been suggested a code (hereinafter 'contour noise free code') that allows all sub-fields from a sub-field arranged at an initial time of the frame until sub-fields arranged thereafter to be continuously turned on in response to an enlargement of a gray level value as shown in FIG. 4. In the contour noise free code, a brightness weighting value of each sub-field is determined in order that an emission of a light can be linearly increased, when viewed at the time axis, to thereby prevent a generation of the contour noise as shown in FIG. 5.

As can be seen from FIG. 6, the contour noise free code has a disadvantage that an expressible gray level value is limited to 'the number of sub-fields plus 1'. For example, in the contour noise free code as shown in FIG. 5, a brightness weighting value of each sub-field is set to 1, 2, 4, 8, 16, 24, 32, 40, 56 and 72 to thereby limit the gray level value into 11 gray levels of 0, 1, 3, 7, 15, 31, 55, 87, 127, 183 and 255 corresponding thereto.

For this reason, a use of the contour noise free code raises a problem that though no contour noise is generated, the number of expressible gray levels becomes insufficient to deteriorate a picture quality. In order to compensate for such a reduction in total number of gray levels from the contour noise free code, a multi-toning technique using an error diffusion method, which permits to visually recognize a larger number of gray levels than the number of real gray levels, may be applied. However, the multi-toning technique brings about a deterioration of picture quality caused by an error diffusion artifact or a dithering pattern, etc.

In the mean time, a light-emission pattern determined by a combination of sub-fields is selected from a considerably large number of events. For this reason, it is virtually impossible to find out an optimal light-emission pattern capable of minimizing the contour noise from all possible light-emission patterns.

SUMMARY OF THE INVENTION

Accordingly, it is an object of the present invention to provide a method of generating an optimal light-emission pattern for a plasma display panel in order to select a light-emission pattern where a moving picture pseudo contour noise is minimized.

Another object of the present invention is to provide a method of measuring a contour noise for a plasma display panel in order to rapidly calculate a contour noise degree.

It is still another object of the present invention to provide a method of selecting a gray scale in order to select a sub-field array and a gray scale with which the contour noise is minimized.

In order to achieve these and other objects of the invention, a method of generating an optimal light-emission pattern for a plasma display panel according to one aspect of the present invention includes steps of determining a plurality of light-emission patterns with respect to an arbitrary gray level; calculating a contour noise degree between a contour noise free gray level being set in advance and the light-emission patterns given to each gray level in plurality; and selecting a light-emission pattern whose contour noise degree is minimal as a light-emission pattern with respect to an arbitrary gray level.

In the method, the contour noise degree is calculated by the sum of contour noise distance dCN defined as following equation.

$$dCN(Bi,Bj,SP)=|Bi-Bj|\square SP-i-j|$$

Herein, Bi, Bj is light-emission pattern codes of gray level i and gray level j respectively, and SP is brightness weighting values of all sub-fields.

A method of measuring a contour noise of a plasma display panel according to another aspect of the present invention includes steps of determining a plurality of sub-field arrays; calculating a contour noise degree between a contour noise free gray level being set in advance and each gray level of the sub-field arrays; summing up the contour noise degree of each gray level calculated; and selecting any one among the sub-field arrays in accordance with the sum of the contour noise degree.

The method further includes a step of selecting a sub-field array, the sum of whose contour noise degree is minimal, among sub-field arrays, the sum of whose contour noise degree is calculated.

The method further includes a step of after summing up the contour noise degree of each gray level calculated, calculating an average contour noise degree per gray level of the sub-field array by dividing the sum by the total number of gray levels.

The method further includes a step of after summing up the contour noise degree of each gray level calculated with respect to at least one sub-field array that has the total number of gray levels different from that of the sub-field arrays determined in the step of determining a plurality of sub-field arrays, calculating an average contour noise degree per gray level of the sub-field array by dividing the sum by the total number of gray levels.

The method further includes a step of selecting a sub-field array whose average contour noise degree per gray level is minimal among a plurality of sub-field arrays whose average contour noise degree per gray level is calculated.

In the method, the contour noise degree is calculated by the sum of contour noise distance dCN defined as following equation.

$$dCN(Bi,Bj,\ SP)=|Bi-Bj|\square SP-|i-j|$$

Herein, Bi, Bj is light-emission pattern codes of gray level i and gray level j respectively, and SP is brightness weighting values of all sub-fields.

A method of measuring a contour noise of a plasma display panel according to still another aspect of the present invention includes steps of determining a plurality of sub-field arrays to which brightness weighting values are given by sub-fields; calculating a contour noise degree between a contour noise free gray level being set in advance and each gray level of the sub-field arrays; dividing the contour noise degree by a threshold value set differently in a gray level scope that is not larger than a specific gray level value and a gray level scope that is not less than the specific gray level value; summing up the contour noise degree divided by the threshold value; and selecting a sub-field array, the sum of whose contour noise degree is minimal.

The method further includes a step of after summing up the contour noise degree divided by the threshold value, calculating an average contour noise degree per gray level of the sub-field array by dividing the sum by the total number of gray levels.

The method further includes a step of selecting a sub-field array whose average contour noise degree per gray level is minimal among a plurality of sub-field arrays whose average contour noise degree per gray level is calculated.

A method of selecting a gray level for a plasma display panel according to still another aspect of the present invention includes steps of determining a sub-field array to which brightness weighting values are given by sub-fields; calculating a contour noise degree between a contour noise free gray level being set in advance and each gray level of the sub-field array; comparing the contour noise degree with the threshold value being set in advance, then selecting only gray levels whose contour noise degree is smaller than the threshold value; and displaying an image only with the selected gray level.

In the method, the contour noise degree is calculated by the sum of contour noise distance dCN defined as following equation.

$$dCN(Bi,Bj,SP)=|Bi-Bj|\square SP-|i-j|$$

Herein, Bi, Bj is light-emission pattern codes of gray level i and gray level j respectively, and SP is brightness weighting values of all sub-fields.

In the method, the threshold value is determined in accordance with at least any one of the amount of the contour noise degree and a gray level expression scope where it is possible to be displayed.

The method further includes a step of performing an error diffusion with respect to the gray level of the image for compensating a non-selected gray level that is bigger than the threshold value.

In the method, the threshold value is set differently in a low gray level that is not larger than a specific gray level value and in a high gray level that is not less than the specific gray level value.

In the method, the threshold value increases by a different gradient from each other respectively in a low gray level and a middle gray level that are not larger than a specific gray level value, and sustains a fixed value in a high gray level that is not less than the specific gray level value In the method, the threshold value increases linearly in a low gray level scope where the gray level is not larger than a specific gray level value, and sustains a fixed value in a high gray level scope where the gray level is not less than the specific gray level value.

A method of selecting a gray level for a plasma display panel according to still another aspect of the present invention includes steps of determining a plurality of sub-field arrays to which brightness weighting values are given; calculating a contour noise degree between a contour noise free gray level being set in advance and each gray level of the sub-field arrays; comparing the contour noise degree with the threshold value being set in advance, then selecting only gray levels whose contour noise degree is smaller than the threshold value; and selecting a sub-field array with its frequency of use maximal in reference of the frequency of use of the selected gray level.

A method of selecting a gray level for a plasma display panel according to still another aspect of the present invention includes steps of determining a plurality of sub-field arrays to which brightness weighting values are given; calculating a contour noise degree between a contour noise free gray level being set in advance and each gray level of the sub-field arrays; comparing the contour noise degree with the threshold value being set in advance, then selecting only gray levels whose contour noise degree is smaller than the threshold value and setting a gray level that is bigger than the threshold value as a non-selected gray level; and calculating the frequency of use of the non-selected gray level, and selecting a sub-field array with its frequency of use minimal.

BRIEF DESCRIPTION OF THE DRAWINGS

These and other objects of the invention will be apparent from the following detailed description of the embodiments of the present invention with reference to the accompanying drawings, in which:

FIG. 9 shows an example of an optimal light-emission pattern selected by the optimal light-emission pattern generating method for the plasma display panel according to the embodiment of the present invention;

FIG. 18 represents sub-field array groups selected in an experiment for verifying a gray level selecting method for a plasma display panel according to another embodiment of the present invention;

DETAILED DESCRIPTION OF THE PREFERRED EMBODIMENT

With reference to FIGS. 7 to 29, there are explained preferred embodiments of the present invention, as follows.

In a method of generating an optimal light-emission pattern according to an embodiment of the present invention, an optimal light-emission pattern having a contour noise as minimal as possible is selected from light-emission patterns consisting of a combination of sub-fields to each of which a brightness weighting value is given on a basis of 'contour noise distance'. Herein, the contour noise distance is defined as a possibility of the occurrence of the contour noise that is generated between two gray levels.

The contour noise distance is defined by a value that is obtained by subtracting an absolute value of a difference between real two gray levels from a value given by multiplying exclusive OR (XOR) operated values of binary light-emission pattern codes corresponding to two gray levels i and j by brightness weighting values of sub-fields corresponding to all figure numbers and then summing the multiplied values as indicated by the following equation:

[Formula]

$$dCN(Bi,Bj,SP)=|Bi-Bj|\cdot SP-|i-j| \quad (1)$$

Wherein, dCN represents a contour noise distance; Bi and Bj represent light-emission pattern codes of gray levels i and j, respectively; and SP does brightness weighting value of all sub-fields.

Figure 1:
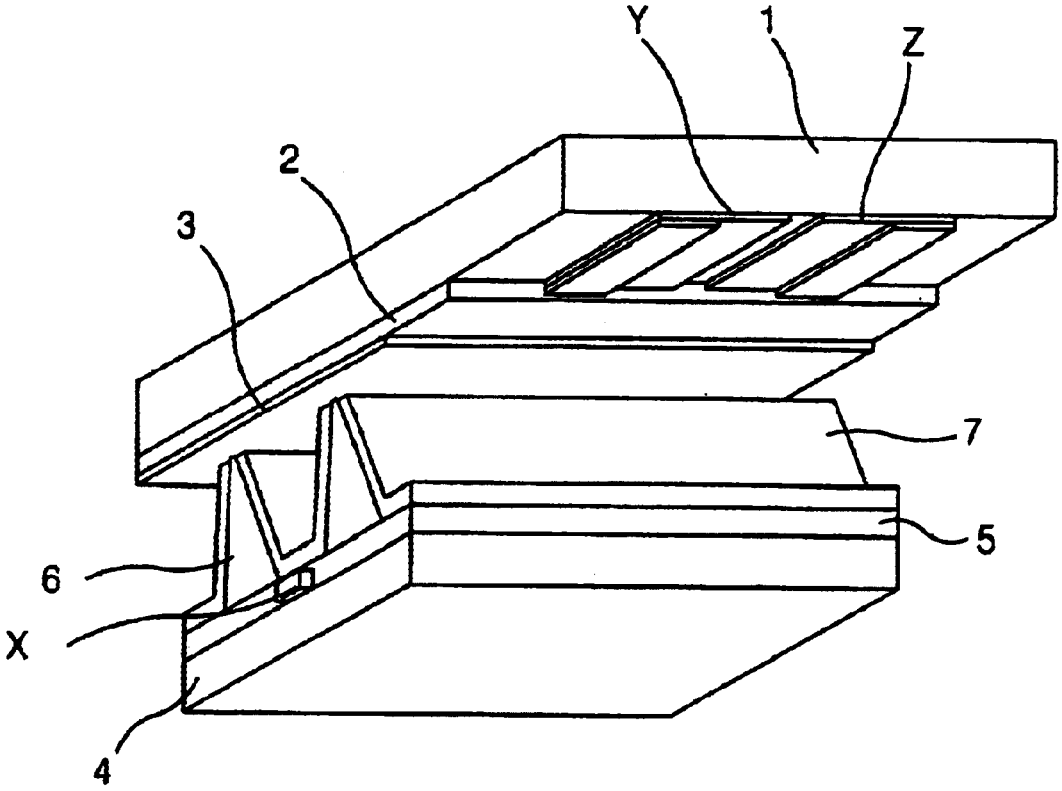
FIG. 1 PRIOR ART
FIG. 1 is a perspective view showing a structure of a discharge cell of a conventional three-electrode, AC surface-discharge plasma display panel.
Figure 2:
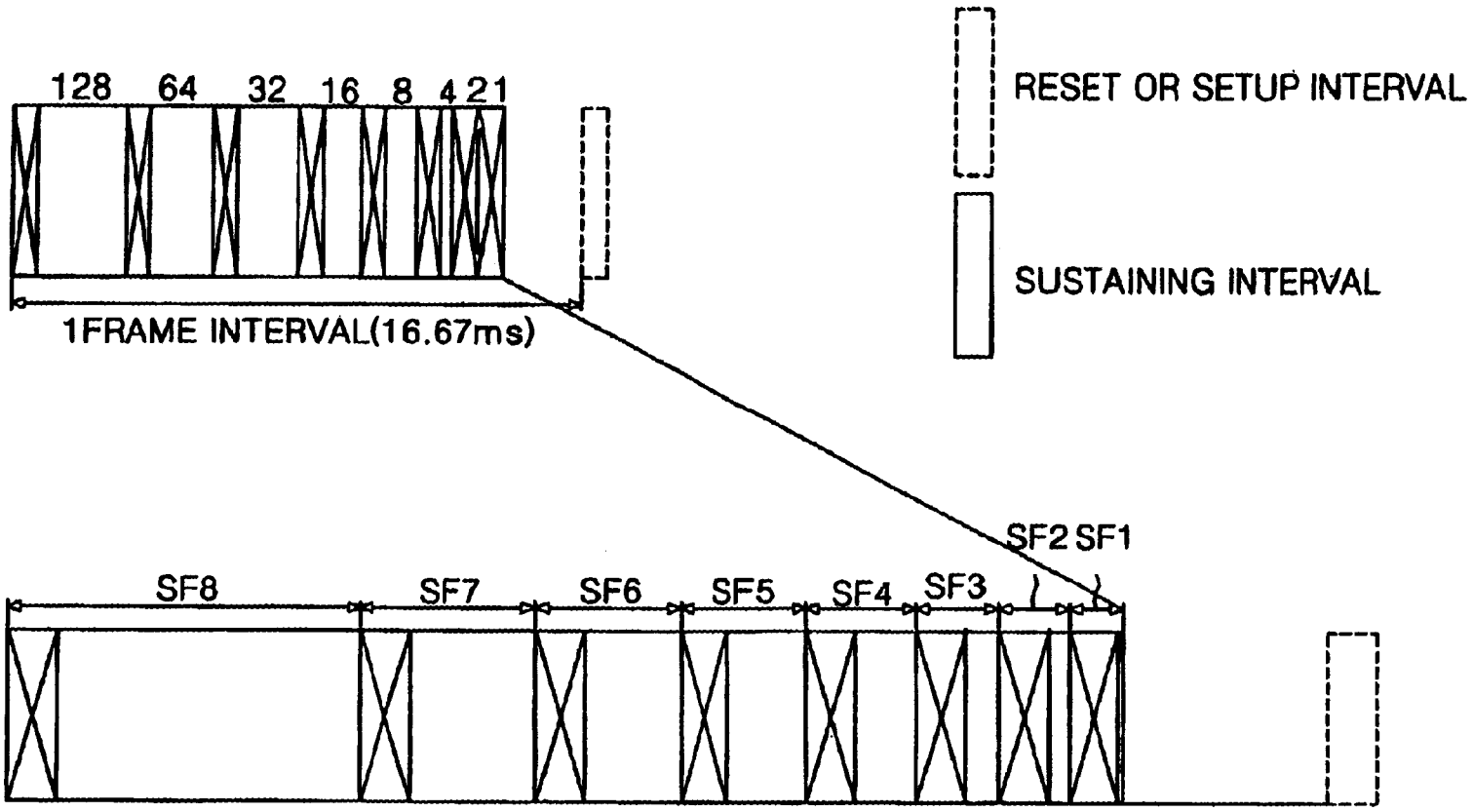
FIG.2 PRIOR ART
FIG. 2 depicts one frame configuration of 8-bit default code.
Figure 3:
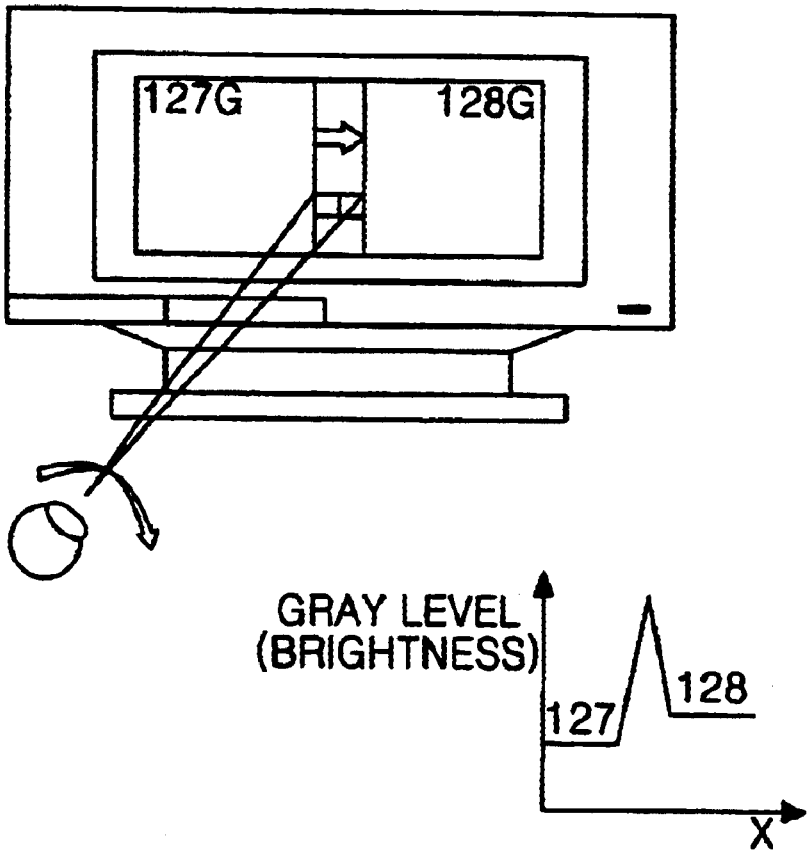
FIG. 3 PRIOR ART
FIG. 3 depicts a movement of a screen, in which a gray level value of '127' and a gray level value of '128' coexist, to the right.
Figure 4:
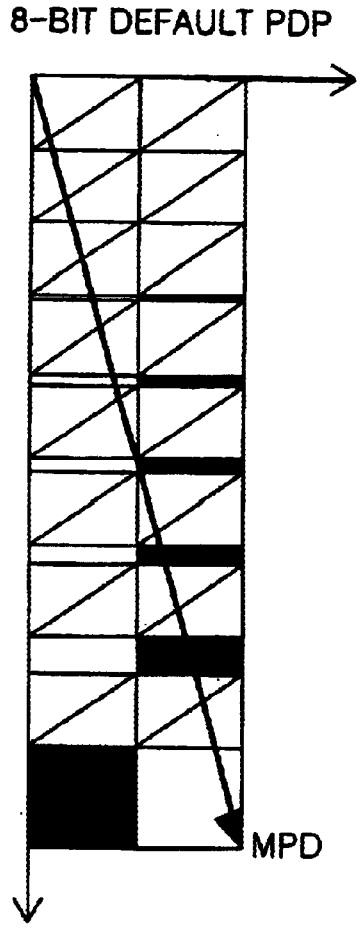
FIG. 4 PRIOR ART
FIG. 4 represents a turn-on/off of sub-fields in the 8-bit default code as shown in FIG. 2 and a trace of a human eye.
Figure 4:
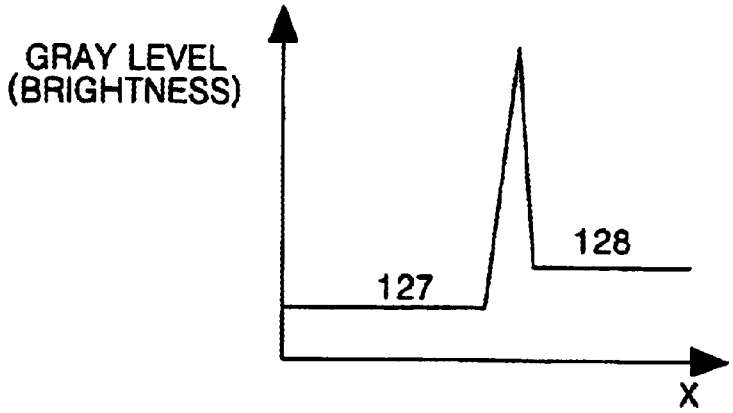
FIG. 4 PRIOR ART
Figure 5:
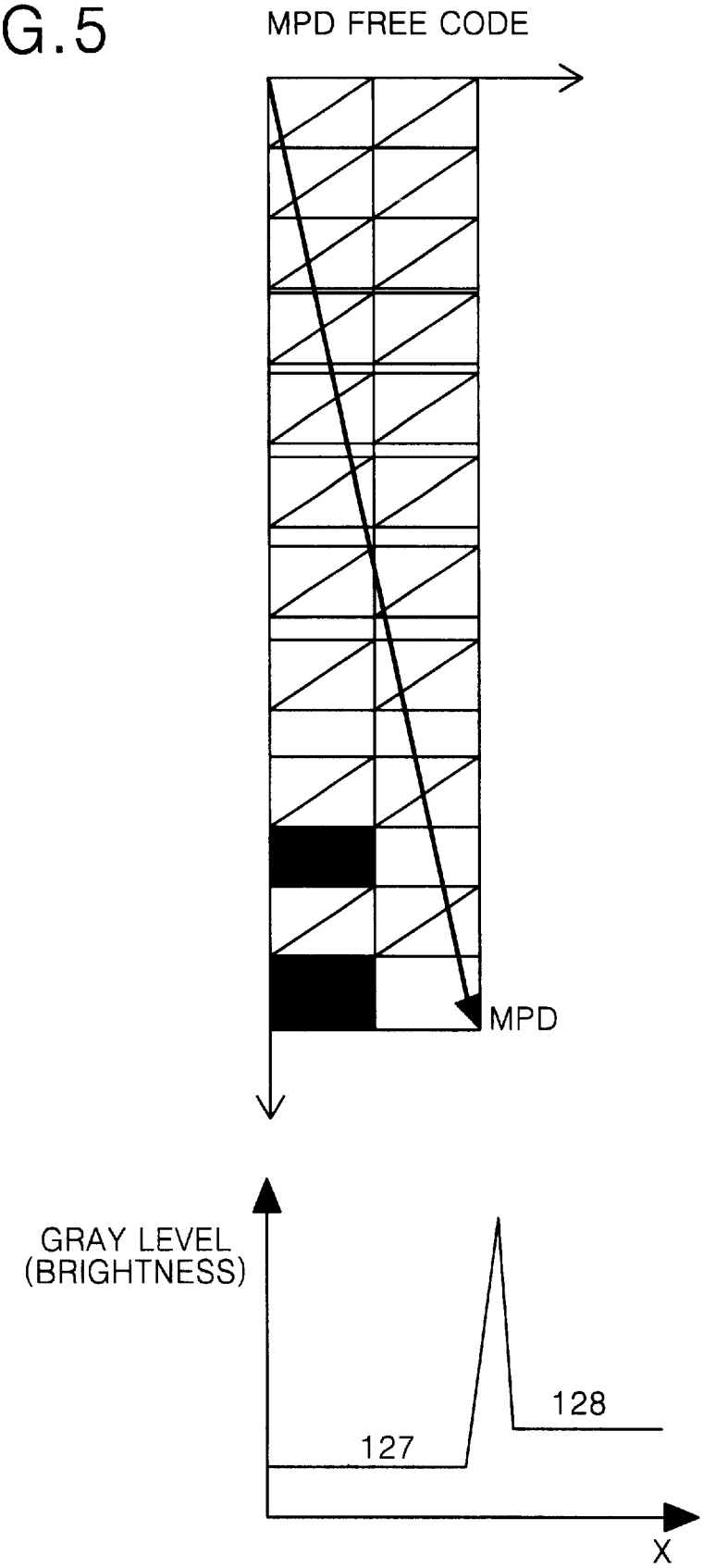
FIG. 5 represents a turn-on/off of sub-fields in a conventional contour noise free code and a trace of a human eye.
Figure 6:
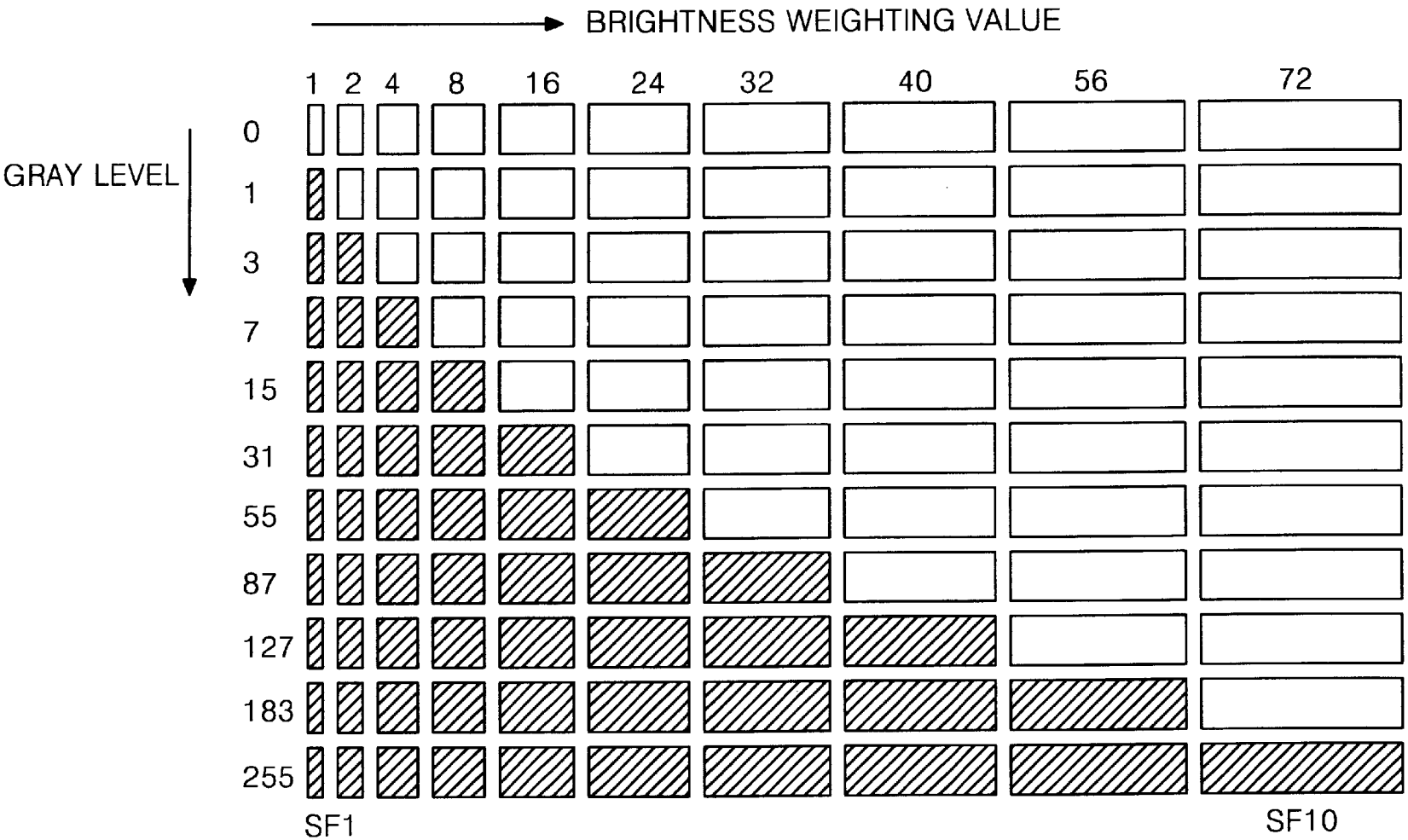
FIG. 6 represents a light-emission pattern characteristic of the conventional contour noise free code.
Figure 7:
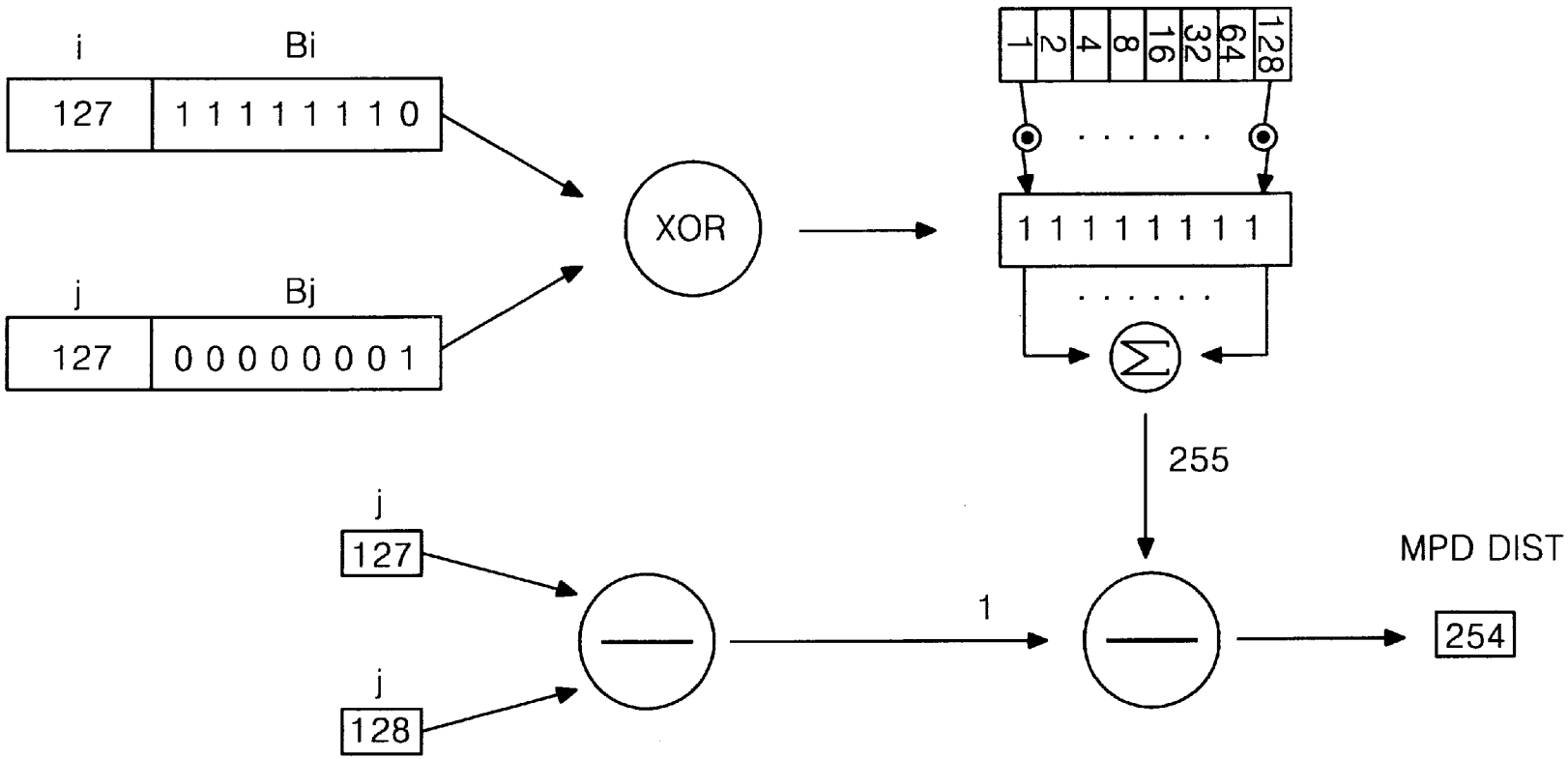
FIG. 7 shows a process of calculating a contour noise distance.

For instance, when brightness weighting values of sub-fields are [1 2 4 8 16 32 64 128], the contour noise distance between the gray levels '127' and '128' is calculated to be '254' by an operation process as shown in FIG. 7.

As a result, in order to measure a contour noise degree of a specific gray level value, the contour noise distance measuring technique should determine which gray level value different from the specific gray level value is subject to a calculation for the contour noise distance between them.

There is calculated the contour noise distance between two gray levels that satisfy the contour noise free condition in use of Formula 1, as follows.

With respect to a sub-field array where a brightness weighting value is [1 2 4 8 16 25 38 39 60 62], the contour noise distance between gray levels '15' and '56' that satisfy the contour noise free condition becomes '0' as follows:

$$\{[1111000000]\ XOR\ [1111110000]\}\cdot SP-|15-56|=[0000110000]\cdot[1\ 2\ 4\ 8\ 16\ 25\ 38\ 39\ 60\ 62]-|15-56|=0$$

Because a gray level expression system of a PDP should emit lights continuously when viewed at the time axis for satisfying the contour noise free condition, a contour noise degree of a gray level for minimizing a contour noise can be defined as a sum of contour noise distances (hereinafter 'contour noise distance sum') between the gray level to be measured and each of gray levels that satisfy the contour noise free condition.

In other words, the contour noise degree of the gray level for minimizing the contour noise is calculated by finding the contour noise distance between the contour noise free code emitting lights linearly on the time axis and the gray level to be measured, and summing up the found contour noise distances.

If a brightness weighting value and a sequence of each sub-field are determined, there can exist a number of light-emission patterns of a specific gray level value. In other words, there can exist a number of binary codes having a weighting value of a sub-field, from which the same specific gray level value is drawn. In this way, a light-emission pattern in regard to the specific gray level that is drawn to a number of the light-emission patterns repeatedly operates by loops of the number of $2^n$ if the number of the sub-fields are 'n', to be drawn to the light-emission pattern where each brightness weighting value of the sub-fields appears as the specific gray level value.

The optimal light-emission pattern generation method according to the embodiment of the present invention calculates the contour noise distance sums between the contour free code and each of a number of the light-emission patterns corresponding to a gray level value, and selects the light-emission pattern with its sum minimized as an optimal light-emission pattern. To be more particular, it is as in FIG. 8.

Figure 8:
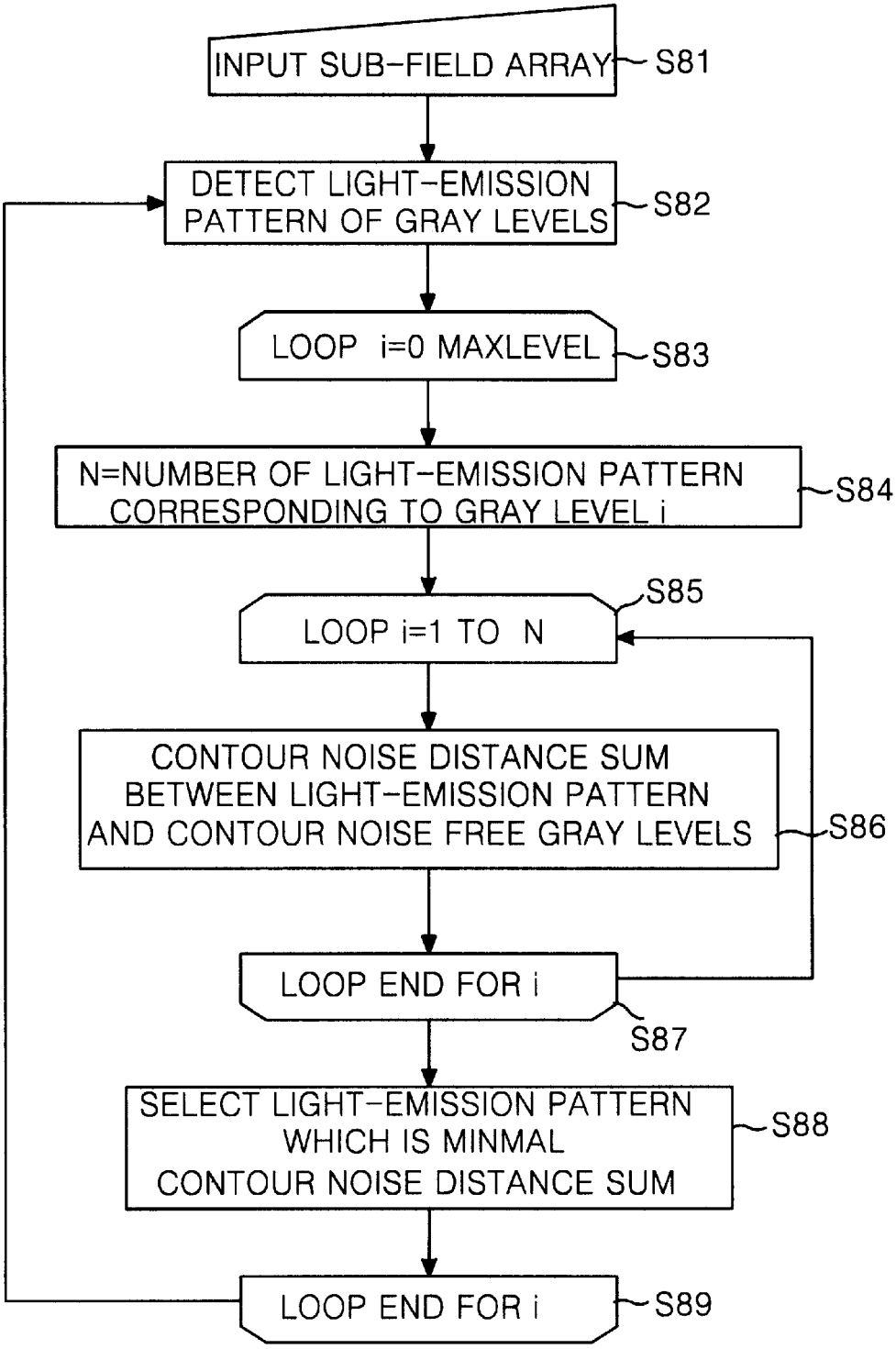
FIG. 8 is a flow chart showing a control procedure in a method of generating an optimal light-emission pattern for a plasma display panel according to an embodiment of the present invention step by step.

Referring to FIG. 8, in the optimal light-emission pattern generation method according to the embodiments of the present invention, first of all, the brightness weighting values (sub-field structure vectors) corresponding to each sub-field are inputted, then the light-emission pattern is detected with respect to the gray level value i determined by combination of their brightness weighting values. (S81 and S82) Subsequently, the method of this invention initializes a count, then accumulates the count whenever the same light-emission pattern is detected with respect to the gray level value i.(S83 and S84)

If all light-emission patterns are detected with respect to the gray level value i, the contour noise distance sums between the light-emission patterns of the gray level value i and the contour noise free gray levels are repeatedly calculated as frequent as the number of the detected light-emission. (S85 and S87) The minimal value among the contour noise distance sums between each light-emission pattern of the gray level value i calculated in this way and the contour noise free gray levels is selected to be an optimal light-emission.(S88) Subsequently, it goes back to the step S82 and the step 82 to 88 are conducted again on the all gray level values possible by the brightness weighting value of the sub-field inputted at the step S81.(S89)

When the brightness weighting values of a sub-field array are [1 4 43 24 10 47 31 15 31 43 4 2], there are shown light-emission patterns for each of gray level values '62', '124' and '202' and an optimal light-emission pattern selected by the optimal light-emission pattern generation method of this invention with respect to these gray level values, shown as in FIG. 9. In FIG. 9, the light-emission pattern selected by the optimal light-emission pattern generation method of this invention has its background color inverted in black.

Referring to FIG. 9, when the brightness weighting values of the sub-field array are [1 4 43 24 10 47 31 15 31 43 4 2], the light-emission patterns detected for each of gray level values '62', '124' and '202' are 18, 37 and 12 patterns respectively. Among such light-emission patterns, the optimal light-emission patterns of the gray level values '62, '124' and '202 selected by the optimal light-emission pattern generation method according to the present invention are '111010000010', '001110000000' and '101111111000' respectively. As it can be seen in such an optimal light-emission pattern, the light-emission pattern generated by the optimal light-emission pattern generation method according to the present invention becomes similar to the light-emission pattern that satisfies the contour noise free condition.

To verify a picture quality improvement effect of the optimal light-emission pattern selected by the optimal light-emission pattern generation method according to the present invention, the following experiment was carried out in use of a contour noise simulator. The contour noise simulator displays an experimental image on a PDP, takes photograph of an image while reciprocating at a predetermined speed a camera that is positioned in front of the display screen of the PDP with a certain space therebetween, and evaluates the picture quality of the photographed image by a human eye model picture quality evaluation method such as a visual difference prediction VDP.

Herein, the VDP is the human eye model picture quality evaluation method used in the experiment, which was suggested as 'Quality measure of image in PDPs using human visual system' by 'Dea woong Kim' and 'Kih Sahng Hong' in IDW, Nov. 2000. It does not simply perform subtraction operation over a test image and an image photographed by a camera, but it evaluates the picture quality on the basis of a subjective picture quality evaluation of the image that observed through the eye of an observer and composed in the mind of the observer.

This experiment is conducted in the manner of evaluating the picture quality in use of the visual difference prediction while moving the test image at the speed of 2 Pix/frame, 5 Pix/frame with respect to the light-emission patterns randomly selected for each gray level among the optimal light-emission patterns drawn from the sub-field array [1 4 43 24 10 47 31 15 31 43 4 2] which is applied to the optimal light-emission pattern generation method of FIG. 8.

Table 1 shows, as a result of the VDP in accordance with the light-emission pattern and simulation speed, contour noise degrees of the light-emission pattern randomly selected and the light-emission pattern selected by the light-emission pattern generation method according to the present invention.

TABLE 1

| | 2 (Pix/frame) | 5 (Pix/frame) |
|---|---|---|
| Light-emission pattern randomly selected | 13.446 | 15.715 |
| Light-emission pattern selected by this invention | 2.276 | 6.404 |

As it can be seen in Table 1, the contour noise degree of the light-emission pattern selected by the optimal light-emission pattern generation method of the present invention is smaller than the light-emission pattern randomly selected.

Figure 10A:
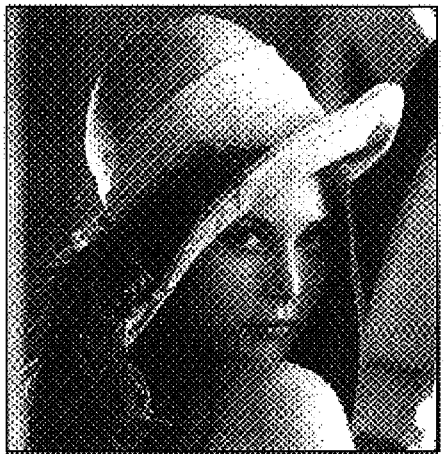
FIG. 10A shows an image photographed while moving at a speed of 2 pixel/frame an initial image that is used in an experiment for verifying the optimal light-emission pattern generating method of the plasma display panel according to the embodiment of the present invention.
Figure 10B:
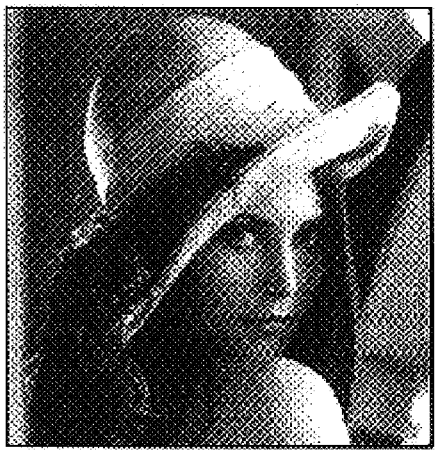
FIG. 10B shows an image photographed while moving at a speed of 2 pixel/frame an image that uses a light-emission pattern randomly selected in an experiment for verifying the optimal light-emission pattern generating method of the plasma display panel according to the embodiment of the present invention.
Figure 10C:
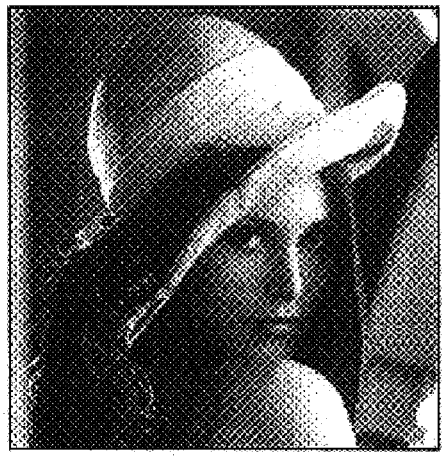
FIG. 10C shows an image photographed while moving at a speed of 2 pixel/frame an image that uses an optimal light-emission pattern selected by this invention in an experiment for verifying the optimal light-emission pattern generating method of the plasma display panel according to the embodiment of the present invention.
Figure 11A:
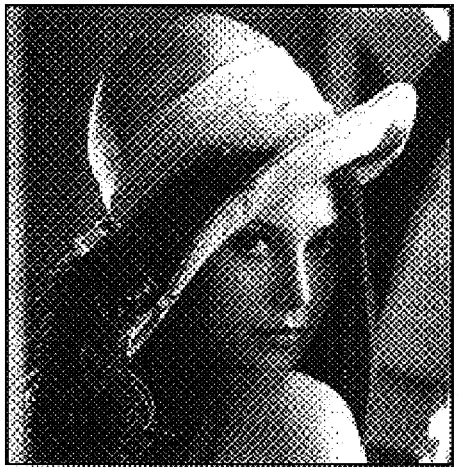
FIG. 11A shows an image photographed while moving at a speed of 5 pixel/frame an initial image that is used in an experiment for verifying the optimal light-emission pattern generating method of the plasma display panel according to the embodiment of the present invention.
Figure 11B:
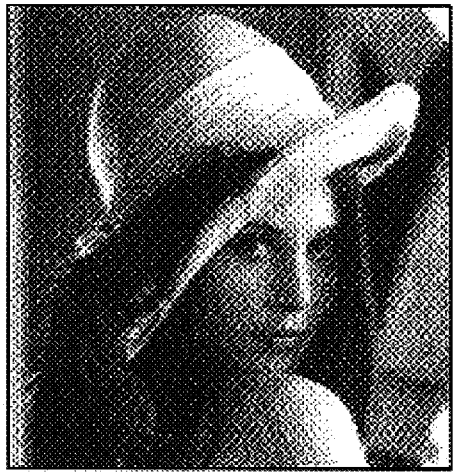
FIG. 11B shows an image photographed while moving at a speed of 5 pixel/frame an image that uses a light-emission pattern randomly selected in an experiment for verifying the optimal light-emission pattern generating method of the plasma display panel according to the embodiment of the present invention.
Figure 11C:
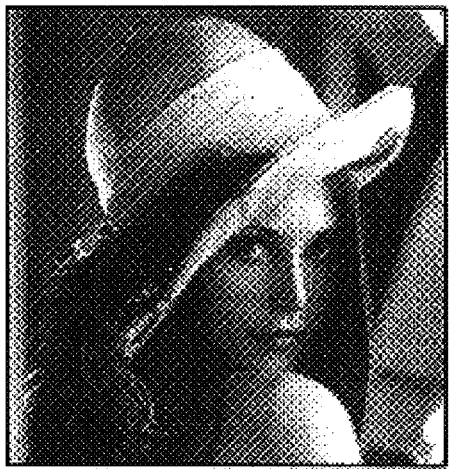
FIG. 11C shows an image photographed while moving at a speed of 5 pixel/frame an image that uses an optimal light-emission pattern selected by this invention in an experiment for verifying the optimal light-emission pattern generating method of the plasma display panel according to the embodiment of the present invention.

FIGS. 10 and 11 show images photographed while moving the screen of an initial image at the speed of 2 Pix/frame and 5 Pix/frame. In FIGS. 10 and 11, FIGS. 10A and 11A are initial images, and FIGS. 10B and 11B are images of the light-emission pattern randomly selected with respect to each gray level. And FIGS. 10C and 11C are images of the light-emission pattern selected by the optimal light-emission generation method according to the present invention.

As a result, if a certain light-emission pattern is randomly selected with respect to the sub-field array where each brightness weighting value is set differently, the contour noise appears big, thereby distorting the picture quality of the PDP as severe as that. On the contrary, because the light-emission pattern selected in use of the optimal light-emission pattern generation method according to the present invention is similar to the light-emission patter of the contour noise free gray level, the picture quality of a moving picture with the contour noise minimal can be obtained without any necessity to compare all possible light-emission patterns with respect to each gray level.

On the other hand, when adopting a conventional method, simulations are repeatedly carried out as a quantitative picture quality evaluation method with respect to each gray level, to spend lots of time to find the light-emission pattern with its contour noise minimal and to result in different outcomes, i.e., different contour noises in accordance with images.

The contour noise measurement method according to the present invention, when the sub-field array and the light-emission pattern are determined, quickly calculates the contour noise degree with respect thereto. This is because the contour noise with respect to a gray level can be measured by the contour noise distance sum between the contour noise free gray level and the gray level to be measured.

The contour noise measurement method according to a first embodiment of the present invention measures the contour noise degree with respect to each sub-field array itself by calculating the contour noise distance sums from a sub-field array group that includes a plurality of sub-field arrays where its gray level is identical and its brightness weighting values are set differently from one another. To be more particular, the contour noise measurement method according to the present invention is carried out in the order of step S1 to step S3.

(S1) there is inputted a plurality of sub-field arrays where its gray level is identical and the light-emission pattern of each gray level in accordance therewith.

(S2) there is calculated the contour noise distance sums between the light-emission patterns corresponding to each gray level and the contour noise free gray level, for measuring the contour noise degree with respect to each gray level of the inputted sub-field array group.

(S3) there is selected, as a sub-field array where the contour noise is generated at its minimum, the sub-field array, whose contour noise distance sum is minimal, from the inputted sub-field array group.

Figure 12:
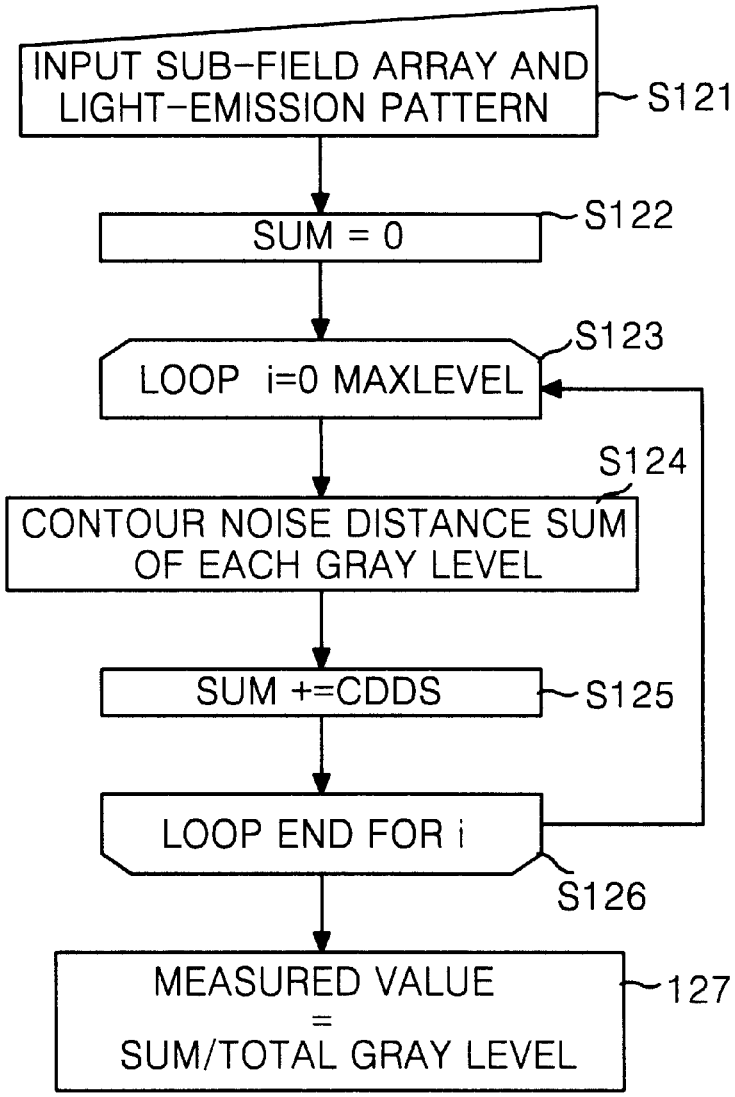
FIG. 12 is a flow chart showing by steps a control procedure in a method of measuring a contour noise of a plasma display panel according to the embodiment of the present invention.

FIG. 12 is a flow chart showing by steps an contour noise degree measurement method according to a second embodiment of the present invention for measuring the contour noise degree of the sub-field array itself in the sub-field array group including sub-field arrays with its total number of gray level different, and selecting the sub-field array with its contour noise at its minimum on the basis of the measured contour noise degree.

Referring to FIG. 12, in the contour noise measurement method according to the second embodiment of the present invention, first of all, there are inputted a specific sub-field array and the light-emission pattern with respect to each gray level in accordance therewith.(S121)

Subsequently, the contour noise measurement method according to the present invention measures the contour noise degree of each gray level by calculating the contour noise distance sums between the contour noise free gray level and the light-emission patterns corresponding to each gray level with respect to all gray levels.(S122 to S126) The contour noise degree of each gray level measured in this way is stored at a memory.

To measure the contour noise degree with respect to the sub-field array itself, the contour noise measurement method according to the present invention sums up the contour noise degree of each gray level, then divides the summed value by the total number of gray level to calculate an average contour noise degree per gray level.(S127)

Similarly, after repeatedly measuring an average contour noise degree with respect to a sub-field array group including arrays of a plurality of sub-fields different from a sub-field inputted beforehand and the light-emission pattern in accordance therewith, there is selected the sub-field array where its average contour noise degree per gray level is at its minimum, as a sub-field array where its contour noise degree is at its minimum, from the sub-field array group whose average contour noise degree per gray level are measured.

As a result of implementing the simulation, the operation speed of the contour noise measurement method according to the present invention becomes faster than the conventional method that measures the contour noise degree of each sub-field array within the same sub-field array group. Especially, because the contour noise degree with respect to a gray level is calculated from the optimal light-emission pattern generation method of FIG. 8, the contour noise degree of each gray level can be measured directly in the course of finding the optimal light-emission pattern.

To verify the accuracy of the contour noise measurement method according to the present invention, the measurement value of the contour noise degree measured in use of the conventional VDP method is compared through an experiment to the measurement value of the contour noise degree measured in use of the contour noise measurement method according to the present invention. In this experiment, a lena image, the test image, is moved in horizontal direction at the speed of 2 Pix/frame.

Figure 13:
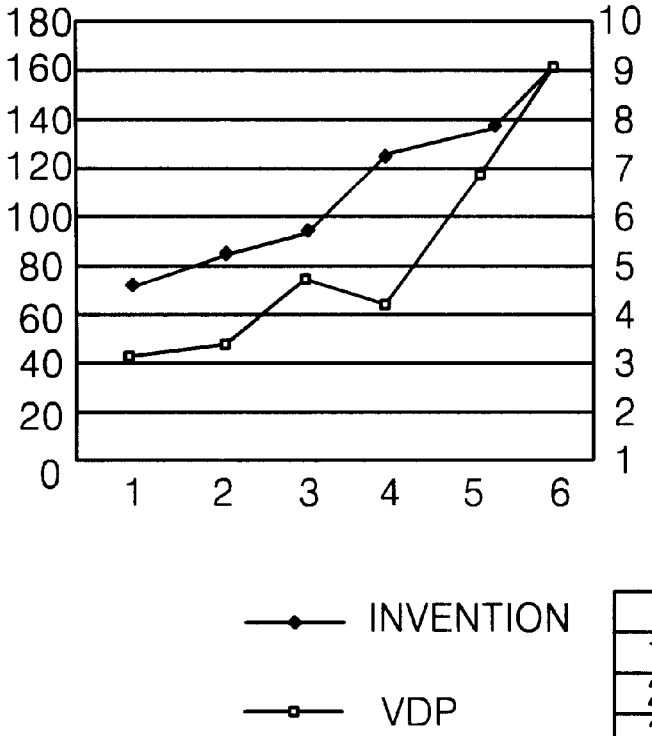
FIG. 13 shows a contour noise measurement value measured by a contour noise measurement method for the plasma display panel according to the embodiment of the present invention and a contour noise measurement value measured by a VDP method.

FIG. 13 represents the conventional VDP measurement value and the measurement value of the contour noise measurement method according to the present invention. In FIG. 13, the left of Y axis represents a measurement unit of the contour noise measurement method according to the present invention, and the right of Y axis represents a measurement unit of the conventional VDP method. Herein, kind items are arranged in the order of subjective evaluation result from good to bad, and the sub-field arrays corresponding to each kind are as in the following Table 2.

TABLE 2

| Kind | Sub-field array |
|---|---|
| 1 | 1, 4, 43, 24, 10, 47, 31, 15, 31, 43, 4, 2 |
| 2 | 4, 2, 7, 48, 13, 22, 37, 33, 33, 46, 9, 1 |
| 3 | 1, 4, 39, 25, 60, 16, 38, 62, 8, 2 |
| 4 | 1, 2, 4, 8, 16, 34, 32, 40, 56, 72 |
| 5 | 1, 4, 16, 64, 128, 32, 8, 2 |
| 6 | 1, 2, 4, 8, 16, 32, 64, 128 |

As it can be seen in FIG. 13, the contour noise measurement method according to the present invention shows the measurement values in the order coinciding with the subjective evaluation perceived by human eye.

Herein, the contour noise measurement value found by the contour noise measurement method according to the present invention is identical to the conventional VDP measurement value in the order of the priority of the rest sub-field arrays except the sub-field arrays of kinds 3 and 4.

In the sub-field arrays 3 and 4, as a result of the analysis of a simulation image and a VDP map, it was confirmed that in the sub-field array 3, the contour noise with respect to one pixel occurs not big and it is spread more broadly over the entire screen than in the sub-field array 4, and in the sub-field array 4, the contour noise with respect to one pixel occurs big and it concentrates on a narrow area. Because of this, the contour noise measurement value with respect to the sub-field array 3 and 4, is presumed to come out differently in the conventional VDP method and the contour noise measurement method according to the present invention.

Consequently, because the conventional simulation image analysis method includes the process of measuring and comparing the contour noise degree as a quantitative value with respect to various sub-field array that have the same total number of gray levels, it takes a lot of time to be carried out. On the contrary, the contour noise measurement method according to the present invention is capable of fining the sub-field array with the contour noise minimal. Also, because the contour noise measurement method according to the present invention gets the contour noise degree with respect to each gray level in the optimal light-emission pattern generation method of FIG. 8, the contour noise degree with respect to the sub-field array can be simultaneously measured upon the generation of the optimal light-emission pattern.

As described above, the optimal light-emission patter generation method according to the embodiment of the present invention, once a sub-field array is determined, shows a method of selecting a light-emission pattern with the contour noise minimal in each gray level that has a plurality of the light-emission pattern exist in its sub-field. Also, the contour noise measurement method according to the present invention shows a method of measuring the contour noise degree of the sub-field array itself, the contour noise degree of each gray level or the average contour noise degree per gray level with respect to the sub-field array group including the sub-field arrays whit its total number of gray level equal to or different from them. Herein, the light-emission pattern of the contour noise measurement method according to the present invention is desirable to be selected by the foregoing optimal light-emission pattern generation method.

A gray level selecting method according to a first embodiment of the present invention includes the steps of calculating the contour noise distance sums from a sub-field array group that includes a plurality of sub-field arrays where its gray level is identical and its brightness weighting values are set differently from one another; dividing the contour noise distance sum of each gray level by the threshold value being set in advance; and selecting the gray level that the contour noise distance sum divided by the threshold value is at its minimum. To be more particular, the contour noise measurement method according to the present invention is carried out in the order of step S21 to step S24.

(S21) there is inputted a plurality of sub-field arrays with its number of gray level equal and the light-emission pattern of each gray level in accordance therewith.

(S22) there is calculated the contour noise distance sum with respect to each gray level by measuring, in use of the foregoing contour noise measurement method, the contour noise degree with respect to each gray level of the inputted sub-field array group.

(S23) there is divided the contour noise distance sum of each gray level calculated in the step S23 by the threshold value being set in advance. Herein, the threshold value is determined by the degree that the contour noise is not distinctively recognizable to human eye, and can be varied in accordance with where the emphasis is given between the contour noise degree and the gray level expressivity. For instance, if the threshold value is set lower, the number of gray level selected gets smaller, whereas the contour noise degree gets much more smaller. On the contrary, if the threshold value is set higher, the number of gray level selected gets larger, whereas, the contour noise degree gets bigger relatively.

(S24) there is selected the gray level with the contour noise distance sum at its minimum among the contour noise distance sums of each gray level divided by the threshold value in the step S23.

Figure 14:
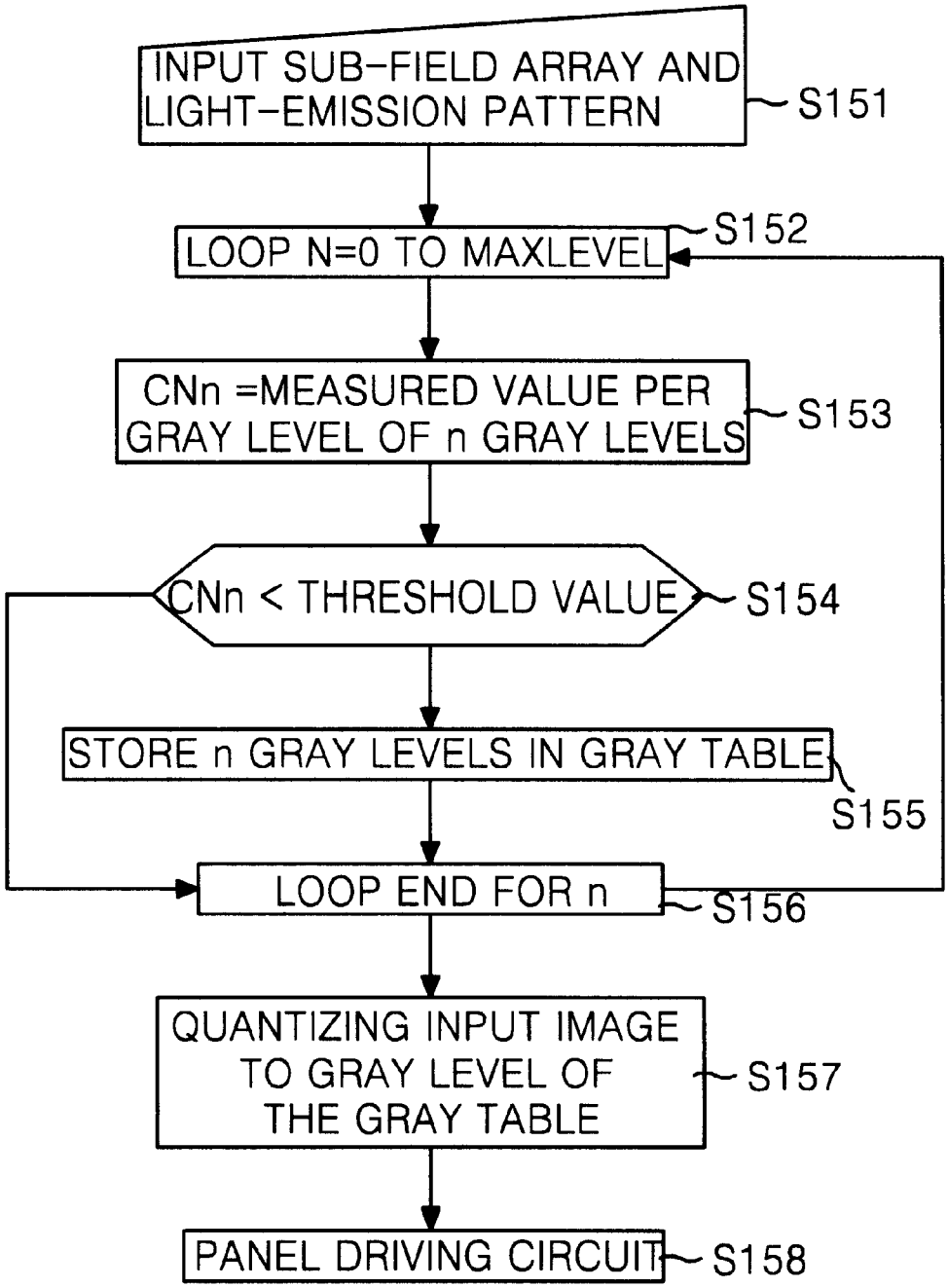
FIG. 14 is a flow chart showing a control procedure in a gray scale selecting method for a plasma display panel according to the embodiment of the present invention step by step.

FIG. 14 represents by steps a gray level selecting method according to a second embodiment of the present invention for selecting the gray level with the contour noise at its minimum from the sub-field array group including the sub-field-arrays that have the total number of gray level different from one another.

Referring to FIG. 14, the gray level selecting method according to the second embodiment of the present invention, first of all, inputs a sub-field array group and light-emission patterns in accordance therewith.(S151)

In steps S152 to S156, the gray level selecting method according to the embodiment of the present invention calculates the contour noise degree of each gray level, as a contour noise distance sum, in application of the foregoing contour noise measurement method.

The contour noise degree CNn of each gray level measured is compared to a certain threshold value. Herein, as described above, the threshold value is determined in the degree with which the contour noise does not appear to be recognizable to human eye. As a result of the comparison to the threshold value, the gray level that has the contour noise degree not larger than the threshold value, i.e., that has the contour noise degree not recognizable to human eye, and the light-emission pattern in accordance therewith are only stored at a gray level table of a sub-field mapping circuit.

In step S157, the gray level table consists of only gray levels whose contour noise degree is not larger than the threshold value and there is quantized only the selected gray level not larger than the threshold value. For compensating the reduction of the number of gray level, the quantization error that occurs when quantizing the selected gray level, is made to be an error diffusion passing through an error filter Lastly, the gray level table consisting of only the gray levels whose contour noise degree is not larger than the threshold value and a driving circuit including the error filter are mounted on a driving circuit board of the PDP.(S158)

An experiment for verifying the gray level selecting method according to the embodiment of the present invention is carried out being divided into two aspects of a contour noise improvement and a gray level expressivity. In the experiment, the used sub-field array and the brightness weighting value in accordance therewith is set to be [17 2 34 53 8 34 16 8 32 46 1 4]. Also, the optimal light-emission pattern with respect to each gray level used in the experiment is selected by the optimal light-emission pattern generation method as in FIG. 8

Figure 15:
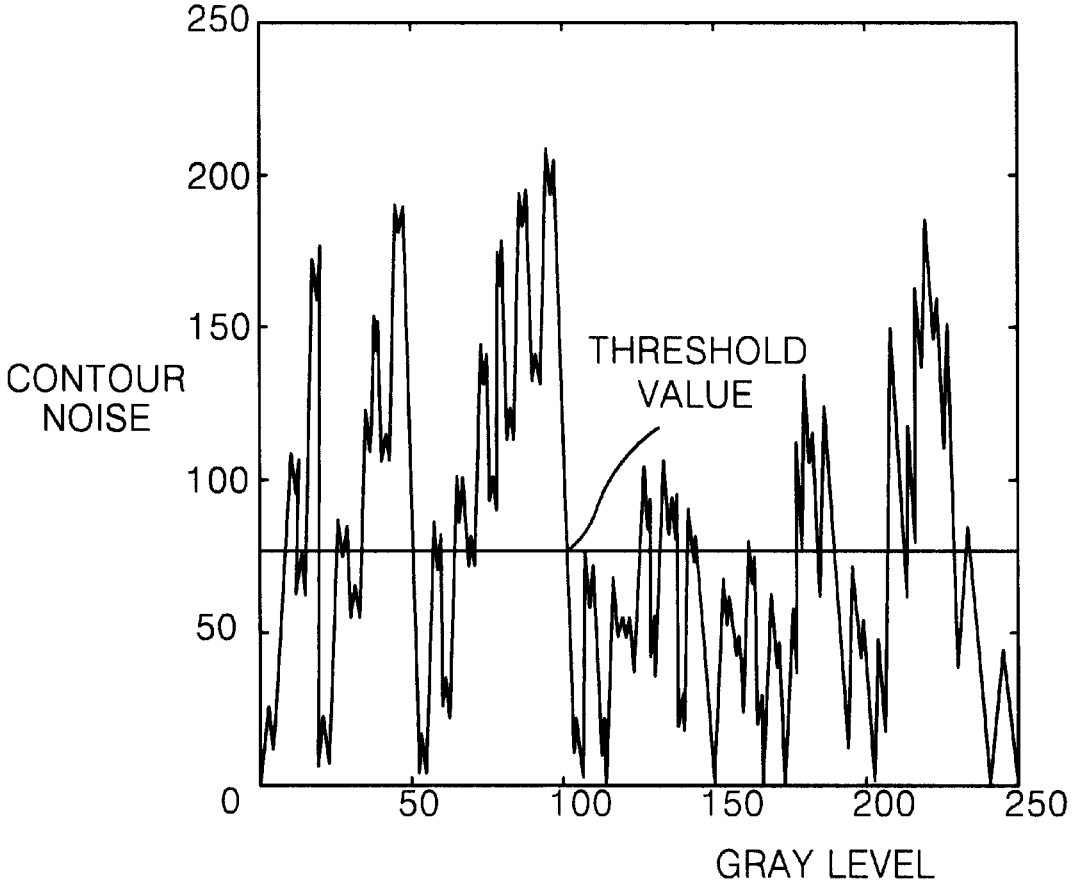
FIG. 15 is a graph showing a threshold value applied to the gray scale selecting method for the plasma display panel according to the embodiment of the present invention.

And in the gray level selecting method according to the embodiment of the present invention, the image expressed only with the gray level value having the contour noise degree below the threshold value and the initial image expressed with all gray levels are moved at the horizontal direction speed of 2 Pix/frame and 5 Pix/frame, and are compared with respect to each image. In the experiment, the threshold value is set to be '79' as shown in FIG. 15, and '125' is the total number of gray levels selected in accordance with the threshold value '79'.

Figure 16A:
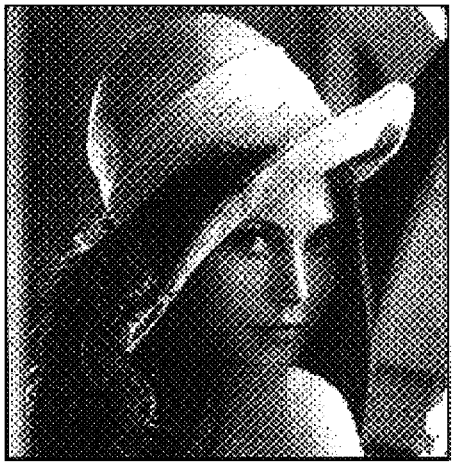
FIG. 16A shows an image photographed while moving at the speed of 2 pixel/frame an initial image that is used in an experiment for verifying a gray level selecting method according to the embodiment of the present invention.
Figure 16B:
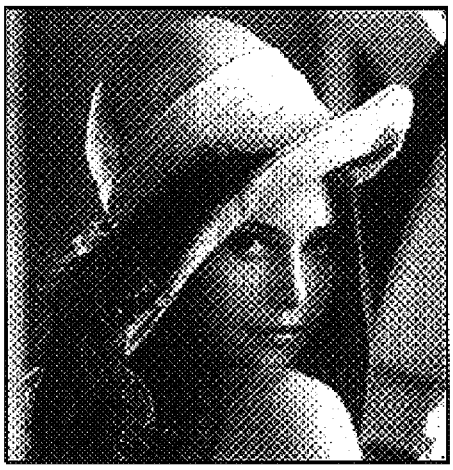
FIG. 16B shows an image photographed while moving at the speed of 2 pixel/frame an image that is displayed only with the contour noise degree of gray levels less than a threshold value in application of a gray level selecting method in an experiment for verifying a gray level selecting method according to the embodiment of the present invention.
Figure 16C:
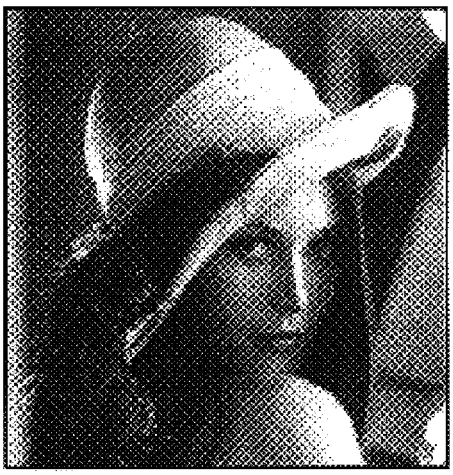
FIG. 16C shows an image photographed while moving at the speed of 5 pixel/frame an initial image that is used in an experiment for verifying a gray level selecting method according to the embodiment of the present invention.
Figure 16D:
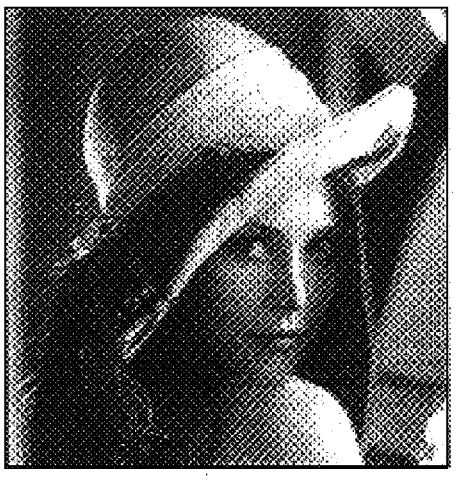
FIG. 16D shows an image photographed while moving at the speed of 5 pixel/frame an image that is displayed only with the contour noise degree of gray levels less than a threshold value in application of a gray level selecting method in an experiment for verifying a gray level selecting method according to the embodiment of the present invention.
Figure 17A:
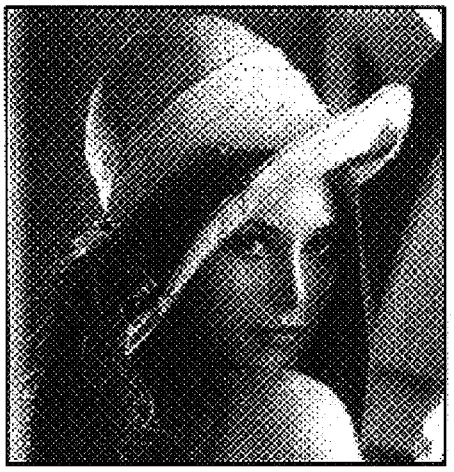
FIG. 17A shows an image with a conventional contour noise free gray level applied in an experiment for verifying a gray level selecting method according to the embodiment of the present invention.
Figure 17B:
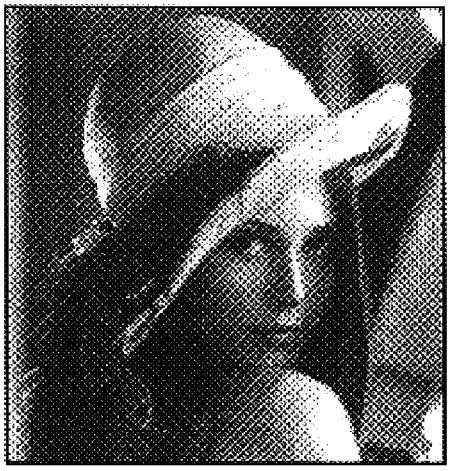
FIG. 17B is an enlarged image of the cheek portion of the image of FIG. 17A.
Figure 17C:
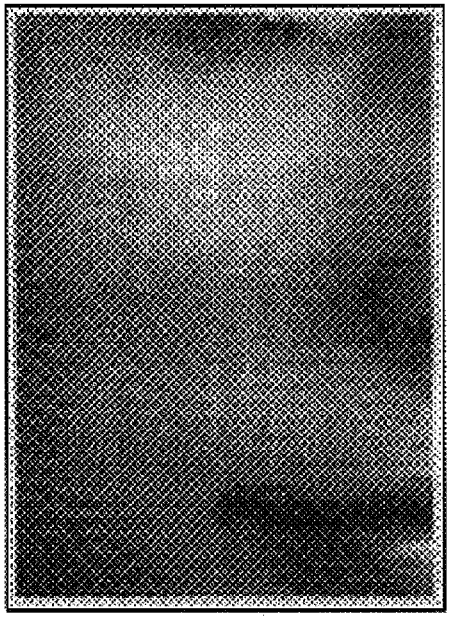
FIG. 17C shows an image made by applying an error diffusion to an image selected by the gray level selecting method in an experiment for verifying a gray level selecting method according to the embodiment of the present invention.
Figure 17D:
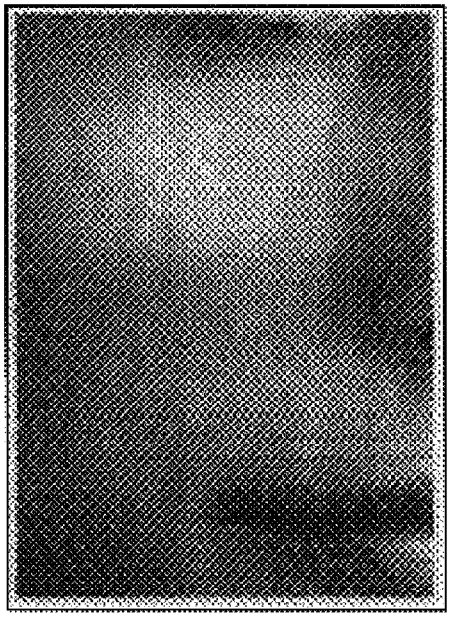
FIG. 17D is an enlarged image of the cheek portion of the image of FIG. 17C.

Firstly, the improvement result of the contour noise degree is explained in conjunction with FIG. 16, as follows. FIG. 16A is the initial image expressed with all gray levels moving at the speed of 2 Pix/frame, FIG. 16C is the initial image expressed with all gray levels moving at the speed of 5 Pix/frame. And FIG. 16B is a result photographed moving at the speed of 2 Pix/frame the image displayed only with 125 gray levels whose contour noise degree is less than the threshold value '79' in application of the gray level selecting method according to the present invention. FIG. 16D is a result photographed moving-at the speed of 5 Pix/frame the image displayed only with 125 gray levels whose contour noise degree is less than the threshold value '79' in application of the gray level selecting method according to the present invention. As it can be seen in FIG. 16, it is confirmed that the image to which the gray level selecting method according to the present invention is applied has a less occurrence of the contour noise even when the movement of the screen is faster than the initial image expressed with all gray levels.

On the other hand, the conventional contour noise free gray level can express the image with the number of the expressible gray level that is small, such as is 9 or 13, shows severe deterioration of the picture quality due to the error diffusion artifact when applying the error diffusion method. On the contrary, as it is confirmed in FIG. 17, the images (FIG. 17C and FIG. 17D) made by applying the error diffusion on the image that its gray level is selected by the gray level selecting method according to the embodiment of the present invention, can reduce the error diffusion artifact more than the images (FIG. 17A and FIG. 17B) of the conventional contour noise free gray level made by applying the error diffusion.

As a result, the gray level selecting method according to the present invention measures the contour noise degree and displays the image only with the gray levels whose contour noise degree is less than the certain threshold value, thereby minimizing the contour noise in the display image and making it capable of richly expressing the gray levels than the conventional contour noise free gray level.

In the gray level selecting method according to a third embodiment of the present invention, there are selected only gray levels whose contour noise degree is not larger than the threshold value, and there are selected gray levels whose frequency of use is high in reference of the histogram of a video signal in the selected gray levels. The histogram in a digital image is an information of the image showing how much each gray level is used, i.e., the frequency of use of the gray level. In other words, the gray level selecting method according to the embodiment of the present invention selects the gray levels in relation with the histogram information.

The gray level selecting method according to the third embodiment of the present invention, firstly, detects the sub-field array group that have different gray level distribution by sub-field arrays. In other words, the gray level selecting method according to the third embodiment of the present invention detects the sub-field arrays different from one another, which have the gray level distribution different from one another, while randomly changing the order of the sub-field and the brightness weighting value given to each sub-field array of the sub-field array group. Herein, the reason that it changes the order of the brightness weighting value of each sub-field is because changing the order of the sub-field has considerably big the number of cases of n! when the number of sub-field is 'n' provided that 'n' is a positive integer.

In the sub-field array group detected in this way, the light-emission pattern where the contour noise is minimal, is selected in use of the foregoing optimal light-emission pattern generation method. Subsequently, the gray level selecting method according to the third embodiment of the present invention selects only the gray levels not larger than the foregoing threshold value, thereby selecting the gray levels whose contour noise degree is low. Herein, it is possible that there is too big the gap between the gray levels whose contour noise degree is not larger than the threshold value. In this case, the error diffusion artifact can appear in the part where the difference between gray levels is big.

Whereas, the error diffusion artifact is not recognizable to human eye in case that the gap between non-selected gray levels is not larger than '4' among the non-selected gray levels whose contour noise degree is not less than the threshold value. This can be seen from that the error diffusion artifact is almost not observed in the error diffusion area in case that the total number of gray levels is reduced to '52'. Consequently, the expression of the gray level in which the gap of the non-selected gray levels is not larger than '4' can be perceived in human eye similar to the expression of a real gray level in the distribution of the selection gray level selected for the contour noise degree to be within the threshold value.

The gray level selecting method according to the third embodiment of the present invention applies the following limit conditions when selecting the sub-field array to be stored at the PDP in consideration of the characteristic of the distribution of the selection gray level selected on the basis of the threshold value.

limit condition 1: the gap of the non-selected gray level should not be too big. In the experiment, 22~25 is selected as the threshold value for the limit condition 1.

The threshold value can be adjusted to a proper value in accordance with where the emphasis is given between the contour noise degree and the gray level expressivity.

limit condition 2: the threshold value for the non-selected gray levels except the non-selected gray levels whose gap with the selection gray level is not larger than '4' and the selection gray level where the error diffusion artifact is not visible, can be varied in accordance with the total number of gray levels and the picture quality. But, 80~100 is selected in the experiment.

limit condition 3: the selection gray level distribution should not overlap between the sub-field arrays to be stored at the PDP. The threshold value for the limit condition 3 can be varied in accordance with the total number of gray levels and the picture quality. But, 20~50 is selected.

On the other hand, if the threshold value is selected in the limit condition 1 not larger than 8~10, the contour noise almost does not appear in the moving picture, as it is confirmed by the experiment, even though the image is displayed by not using the histogram information and depending on the selection gray levels selected to be not larger than the threshold value.

For examining the overlap of the selection gray level distribution, the distribution of the selection gray level selected by the gray level selecting method according to the third embodiment of the present invention is stored at one-dimensional arrays each whose length is 256. Herein, '1' is allocated to an index corresponding to the selection gray level and '2' is allocated to an index corresponding to the non-selected gray level whose gap is not larger than 4 in the selection gray level distribution stored at the memory array. And '0' is allocated to an index corresponding to the non-selected gray levels. The overlap between arrays of the selection gray level distribution where such indexes are allocated, is distinguished by the case that it is not larger than the threshold value by counting the number of cases where the value corresponding to the index of the same location is different. If coding this in 'C' language using 'for' sentence, it is as follows.

```
for i=0 to 255 {
if (Code1(i) !=Code2(i)) diff++;
}
if (diff<PRAM_SIM) then Code1==Code2
else Code1 !=Code2
```

Next, the gray level selecting method according to the third embodiment of the present invention relates the histogram of the image with a plurality of the selection gray level distribution obtained through the above process. For this, the histogram information is stored as a value stored of the number of the gray levels of the corresponding indexes used in the image in reference of the index information of one-dimensional memory array.

As described above, the distribution of the selected gray level is already stored at the one-dimensional array. Therefore, from the histogram information and the distribution information of the selected gray level, the sum of the histogram values corresponding to the gray level that the selection gray level distribution index value is '1' is bigger, i.e., the gray level used very much frequently in the image, the contour noise is reduced more and the gray level expressivity is better.

The following is an example that an algorithm drawing the best optimal gray level selection result is implemented in 'C' language code with respect to the histogram among the selection gray level distribution.

```
max=0
for i=0 to N (selection gray level distribution) {
measure=0
for n=0 to 255 {
if (Code(i,n)==1) then
measure+=histogram(n)
}
if (measure >max) then {
max=measure
idxmax=i
}
}
```

Herein, idxmax is an index of the selection gray level distribution that has a high correlation with the histogram among 'N' selection gray level distributions.

The followings are the experiments carried out for verifying the picture quality improvement degree with respect to the gray level selecting method according to the third embodiment of the present invention. The reference sub-field array used in the experiment and the brightness weighting value in accordance therewith is [2, 4, 48, 34, 7, 22, 13, 34, 33, 48, 9, 1]. As a result of detecting it while randomly changing the order of the brightness weighting value in the reference sub-field array, 32 of the sub-field arrays satisfying the above limit conditions, as shown in FIG. 18, are drawn.

Figure 19A:
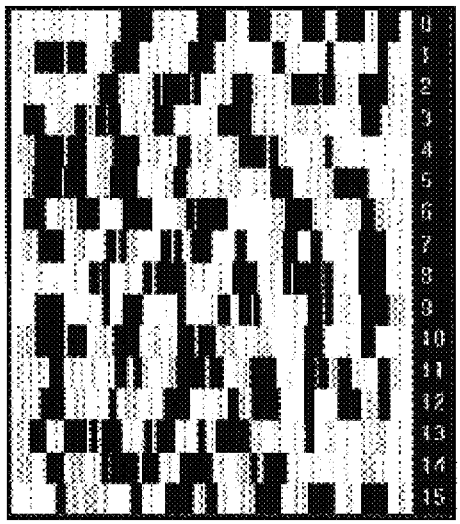
FIG. 19 represents index information given to each sub-field array included in the sub-field groups as in FIG. 18.
Figure 19B:
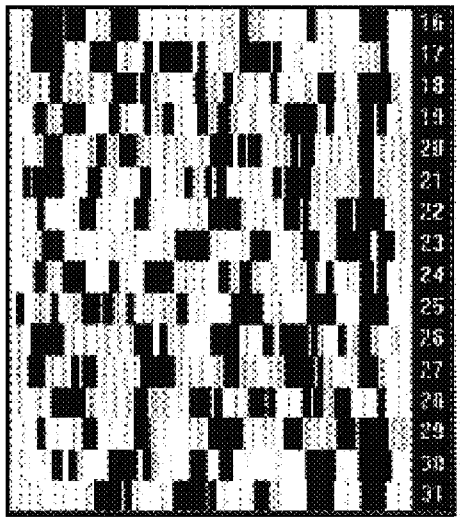

Also, a reference threshold value used in this experiment is '70', a threshold value of the limit condition 1 is '22', a threshold value of the limit condition 2 is '100', and a threshold value of the limit condition 3 is '20'. To put into the form of a diagram the index information with respect to 32 sub-field arrays detected as satisfying the limit conditions, it is as in FIGS. 19A and 19B. In FIGS. 19A and 19B, the index information '1' represents white color, the index information '2' does gray color, the index information '3' does black color. The sub-field arrays selected in this way are stored into the memory for the selection gray level distribution not to overlap. Lastly, the optimal gray levels are selected in accordance with the histogram of the input image, i.e., the frequency of use of the selection gray level, from the sub-field arrays where the selection gray level distribution does not overlap.

The picture quality improvement effect of the picture displayed in application of the gray level selection method according to the third embodiment of the present invention was verified through the experiment carried out being divided into two aspects of the contour noise improvement and the gray level expressivity. In this experiment, one optimal sub-field array is selected in relation with the histogram of the input image among 32 sub-field arrays of FIG. 18 with respect to each of two test images that are different from each other in histograms.

In the point of view of the contour noise improvement, the image displayed by the sub-field array using the prior study 'genetic algorithm' and the image that the total number of gray levels is reduced in application of the gray level selection method according to the third embodiment of the present invention are moved respectively at the speed of 2 Pix/frame to compare the photographed images. Herein, the selecting method of the sub-field array using the genetic algorithm is a human eye model picture quality evaluation method used in the experiment, which was suggested by 'Seung Ho Park', 'Yoon Seok Choi' and 'Choon Woo Kim', as 'Optimum Selection of Subfield Patterns for Plasma Displays based on Genetic Algorithm', in IDW. 1999.

In the point of view of the gray level expressivity, the initial image using the total number of gray levels and the image that the total number of gray levels is reduced in application of the gray level selecting method according to the third embodiment of the present invention, are compared.

Figure 20A:
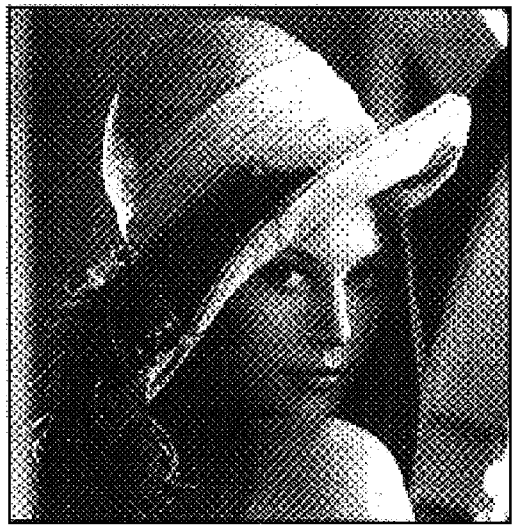
FIG. 20A shows an image photographed while moving at the speed of 2 pixel/frame an image that uses the total number of gray levels in an experiment for verifying a gray level selecting method for the plasma display panel according to the embodiment of the present invention.
Figure 20B:
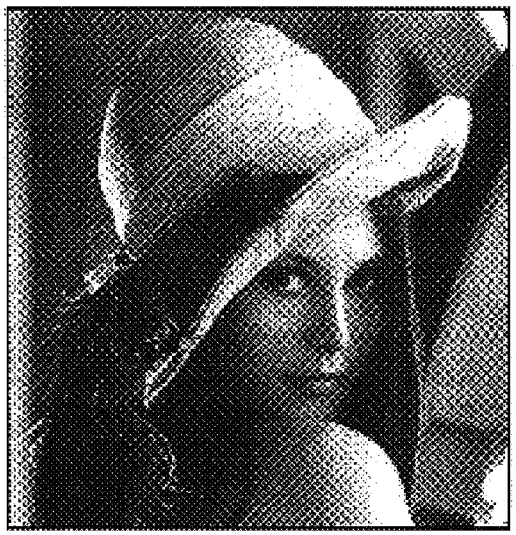
FIG. 20B shows an image photographed while moving at the speed of 2 pixel/frame an image with the total number of gray levels reduced in application of the gray level selecting method in an experiment for verifying a gray level selecting method for the plasma display panel according to the embodiment of the present invention.

FIG. 20A shows an image photographed while moving at the speed of 2 Pix/frame the initial image that uses the total number of gray levels. FIG. 20B shows an image photographed while moving at the speed of 2 Pix/frame the image that the total number of gray levels is reduced in application of the gray level selection method according to the third embodiment of the present invention.

Figure 21:
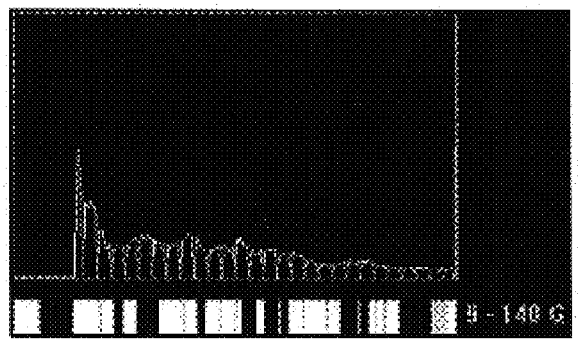
FIG. 21 shows a selection gray level distribution with respect to the sub-field array of the item 9 of FIG. 18 selected, in application of the histogram of the initial image using the total number of gray levels and the gray level selecting method depending on the histogram in an experiment for verifying a gray level selecting method for the plasma display panel according to the embodiment of the present invention.

FIG. 21 represents the selection gray level distribution with respect to the sub-field array of the item 9 of FIG. 18 selected in application of the gray level selecting method according to the third embodiment of the present invention depending upon the histogram and the histogram of the initial image using the total number of gray levels.

Figure 22A:
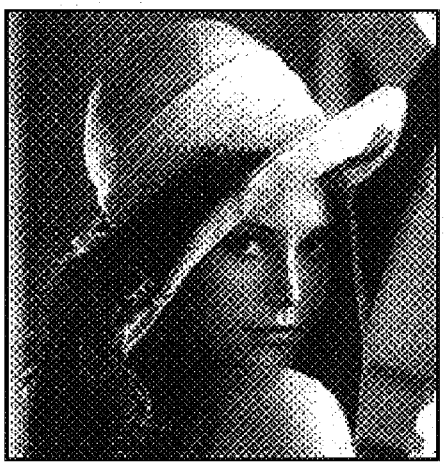
FIG. 22A shows an image photographed while moving at the speed of 5 pixel/frame an image that uses the sub-field array of the item 9 of FIG. 18 selected in application of the gray level selecting method in an experiment for verifying a gray level selecting method for the plasma display panel according to the embodiment of the present invention.
Figure 22B:
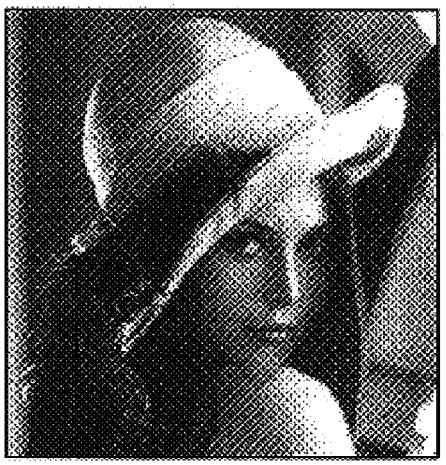
FIG. 22B shows an image photographed while moving at the speed of 5 pixel/frame an image that uses the sub-field array [1, 4, 43, 24, 10, 47, 31, 15, 31, 43, 4, 2] selected in application of a conventional genetic algorithm in an experiment for verifying a gray level selecting method for the plasma display panel according to the embodiment of the present invention.
Figure 23A:
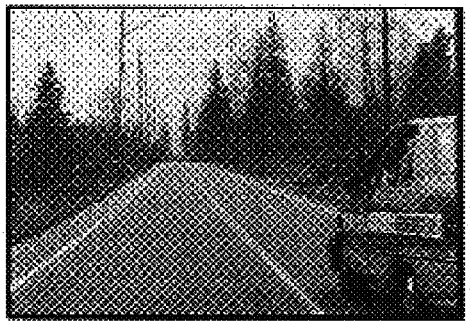
FIG. 23A shows an image photographed while moving at the speed of 2 pixel/frame an initial image that uses the total number of gray levels in an experiment for verifying a gray level selecting method for the plasma display panel according to the embodiment of the present invention.
Figure 23B:
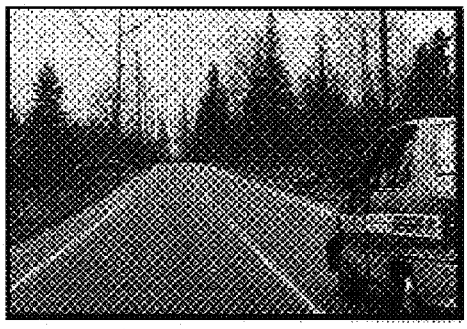
FIG. 23B shows an image photographed while moving at the speed of 2 pixel/frame an image with the total number of gray levels reduced in application of the gray level selecting method in an experiment for verifying a gray level selecting method for the plasma display panel according to the embodiment of the present invention.
Figure 24:
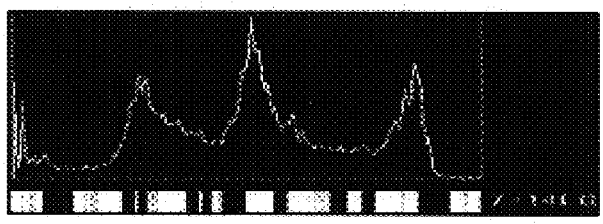
FIG. 24 shows a selection gray level distribution with respect to the sub-field array of the item 7 of FIG. 18 selected, in application of the histogram of the initial image using the total number of gray levels and the gray level selecting method depending on the histogram in an experiment for verifying a gray level selecting method for the plasma display panel according to the embodiment of the present invention.
Figure 25A:
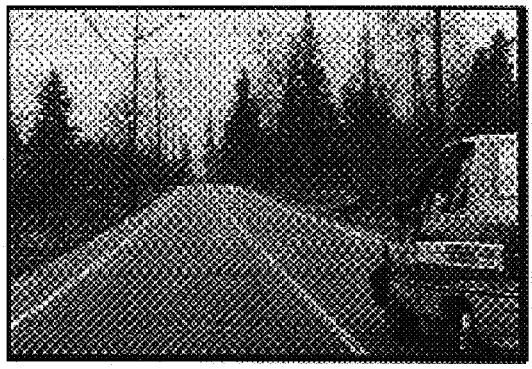
FIG. 25A shows an image photographed while moving at the speed of 5 pixel/frame an image that uses the sub-field array of the item 7 of FIG. 18 selected in application of the gray level selecting method in an experiment for verifying a gray level selecting method for the plasma display panel according to the embodiment of the present invention.
Figure 25B:
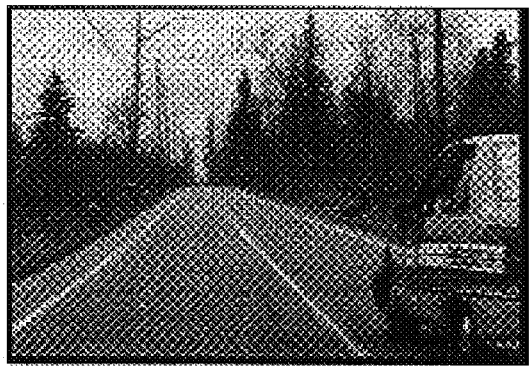
FIG. 25B shows an image photographed while moving at the speed of 5 pixel/frame an image that uses the sub-field array [1, 4, 43, 24, 10, 47, 31, 15, 31, 43, 4, 2] selected in application of a conventional genetic algorithm in an experiment for verifying a gray level selecting method for the plasma display panel according to the embodiment of the present invention.

FIG. 22A shows an image photographed while moving at the speed of 5 pixel/frame an image that uses the sub-field array of the item 9 of FIG. 18 selected in application of the gray level selecting method according to the third embodiment of the present invention. FIG. 22B shows an image photographed while moving at the speed of 5 pixel/frame an image that uses the sub-field array [1, 4, 43, 24, 10, 47, 31, 15, 31, 43, 4, 2] selected in application of a conventional genetic algorithm.

Also, different test images are used to carry out the experiment with respect to the contour noise improvement and the gray level expressivity of the gray level selecting method according to the third embodiment of the present invention in the same way as the above experimental process.

FIGS. 23A to 25B shows experimental results with respect to the sub-field array of the item 7 of FIG. 18 selected in application of the gray level selecting method according to the third embodiment of the present invention and a second test image.

As it can be seen in such a experimental result, the gray level selecting method according the third embodiment of the present invention selects the gray level frequently used in accordance with the histogram of the input image among a plurality of sub-field arrays and selects the sub-field array whose contour noise degree is small from the selected gray levels, thereby reducing the contour noise in the moving pictures.

On the other hand, though the gray level selecting method according to the third embodiment of the present invention has been explained to select the sub-field array that the sum of the number of the selected gray levels and the histogram is maximized by comparing the histogram with the selected gray levels of the sub-field array, but the same result can be obtained even when selecting the sub-field array with its sum minimal by comparing the non-selected gray level and the histogram.

The gray level selecting method according to a fourth embodiment of the present invention has the threshold value applied differently in a low gray level and a high gray level.

There is difference between the contour noise measured in a computer simulation and the contour noise on the PDP observed by human eye. To be more particular, the contour noise degree does not show much difference in most gray levels in the computer simulation. However, the contour noise observed by human eye in the PDP appears more frequently in low gray levels 0~40 and middle gray levels 40~90 relatively. In other words, the amount of the contour noise that occur actually in the PDP, is different from the amount of the contour noise perceived by human eye.

These are explained with an example as follows.

There is assumed that the measurement value of the contour noise measured by the contour noise measuring method of FIG. 12 is equally '20' in a gray level '10' and a gray level '200'. Herein, the measured contour noise degree '20' is twice as large as the gray level '10' being the low gray level, whereas it is 0.1 times as large as the gray level '200' being the high gray level. Accordingly, when people see a picture of the gray level '10' and a picture of the gray level '200' with their eye respectively, even though these has the same contour noise degree, the contour noise is perceived bigger by human eye in the picture of the gray level '10'. Consequently, in case that all possible gray levels are used in the given sub-field array, it is required to evaluate by gray levels what contour noise degrees are not recognizable to human eye. In other words, the threshold value should be chosen to be optimal in accordance with the gray levels whose contour noise are not recognized as severe by human eye in all gray levels.

For verifying the improvement degree of the gray level selecting method according to the fourth embodiment of the present invention, there has been experimented the contour noise degree that is recognizable by human eye and the threshold value chosen to be optimal in accordance with the gray levels. In this experiment, there has been used a sub-field array that the number of the sub-fields are 12 and the total number of the gray levels are 232. And there has been selected two light-emission pattern modes with light-emission patterns different from each other in the sub-field array.

Herein, two light-emission pattern was selected by the optimal light-emission pattern generation method of FIG. 8, the optimal light-emission pattern with its contour noise at the minimum is set to be A mode light-emission pattern, the optimal light-emission pattern with its contour noise at the second to the minimum is set to be B mode light-emission pattern. If only one optimal light-emission pattern is drawn by the optimal light-emission pattern generation method of FIG. 8, The A mode light-emission pattern and the B mode light-emission pattern are set to be identical. Two light-emission patterns selected in this way has the contour noise occur larger than zero if they are not the contour noise free code. The A mode and B mode light-emission patterns selected in this way are actually inputted into the PDP, and the contour noise observed in the picture displayed in the real PDP is observed by human eye.

At this moment, it was judged if the contour noise observed in the real PDP is within the tolerable scope, and the marginal value of the contour noise degree within the tolerable scope was set to be the threshold value of the corresponding gray level. Herein, the tolerable scope was a subjectively judged scope observed to the degree that the contour noise was not conspicuous when the display picture of the real PDP was looked at by human eye. If the threshold value of a specific gray level was determined in this way, the similar threshold values were set with respect to other gray levels adjacent to and around the gray level. As a result of the experiment in the scope of the whole gray levels in this way, the optimal threshold values by gray levels, as follows, are drawn as in Table 3 and FIG. 26.

TABLE 3

| Gray level | 0 | 6 | 15 | 80 | 100 | 231 |
|---|---|---|---|---|---|---|
| Threshold value | 10 | 17 | 28 | 107 | 210 | 210 |

Figure 26:
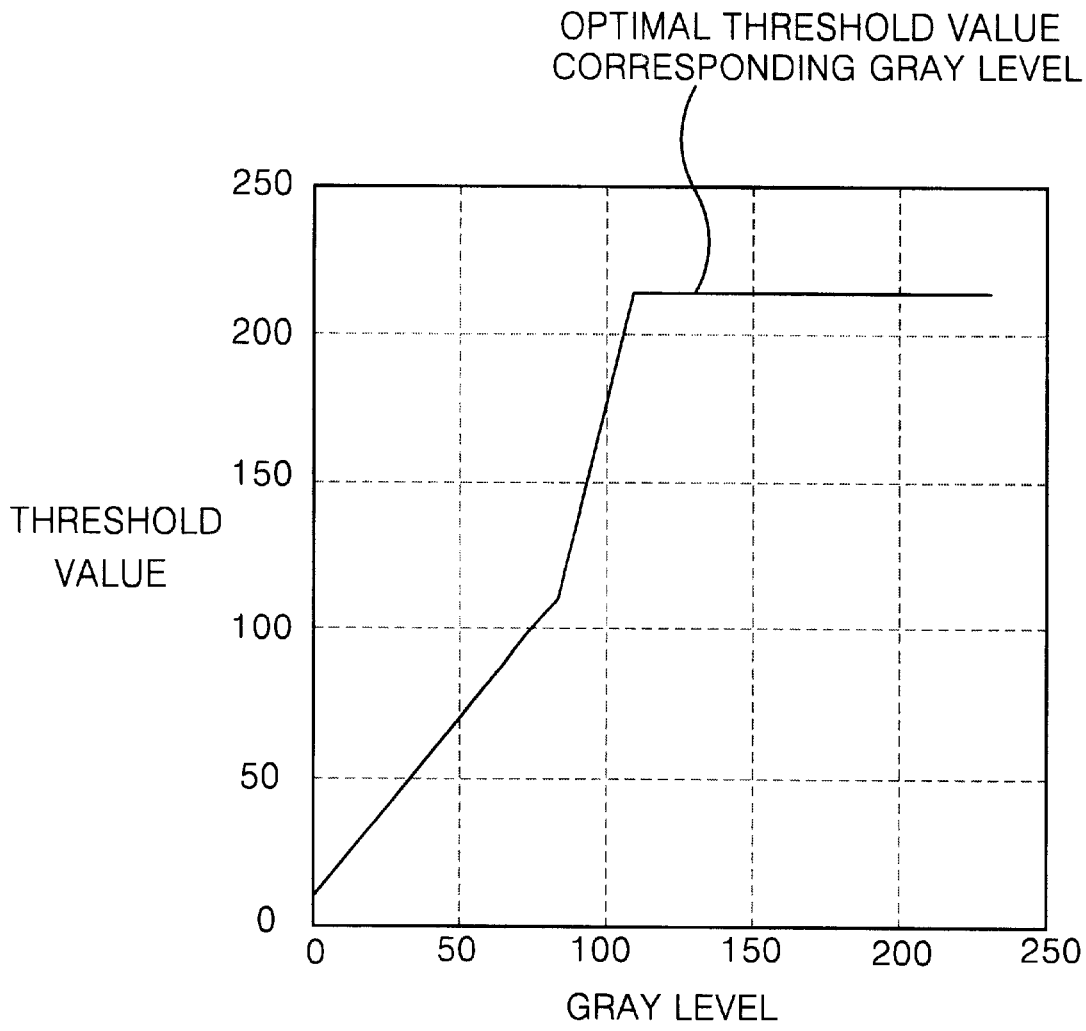
FIG. 26 represents threshold values in accordance with gray levels, applied to the gray level selecting method for a plasma display panel according to still another embodiment of the present invention.

As described above, the gray level selecting method according to the fourth embodiment of the present invention was experimented on with respect to a sub-field array that the number of its sub-fields is '12' and the total number of the gray levels is '232'. The threshold values of Table 3 and FIG. 26 are not changed when the number of sub-fields is changed in such a sub-field array, but if the total number of gray levels is changed, the threshold value should be changed in the form of a proportional expression that the number of gray levels is a function.

Thus, the threshold value chosen to be optimal in accordance with gray levels puts emphasis on the scope of the gray level that has a bigger contour noise degree than the chosen threshold value in the foregoing embodiment, i.e., a fixed threshold value regardless of a gray level, and puts less emphasis relatively on the scope of the gray level that has a smaller contour noise degree than the fixed threshold value regardless of the gray level. For this, the contour noise degree of each gray level is divided by a weighting value R of the threshold value by gray levels and is added in the form of the following Formula 2.

$$P_s = \left\{ \sum_{image} |P_t(i, j)|^{\beta} \right\}^{1/\beta} \tag{2}$$

Herein, $|P_t(i,j)|$ represents a contour noise degree measured between gray levels 'i' and 'j', i.e., the contour noise degree of each gray level. PS represents the contour noise degree of all gray levels, and there is judged the contour noise improvement degree of a sub-field array in reference to this value.

In case that the value of 'R' is '1', it represents that the contour noise degree is added as the contour noise measuring method of FIG. 12. If the value of 'R' increase, it represents that the influence of the contour noise degree per gray level that is bigger than the threshold value affects as much. The value of 'R' is desirable to be selected as in 2~4. To verify this, after observing the image of various sub-field arrays in the real PDP by human eye, the order of each sub-field array was determined in the point of view of contour noise.

Subsequently, the contour noise degree measured with respect to each gray level is divided by the threshold value chosen to be optimal in accordance with gray levels, then all are added, and then the added value is again divided by the total number of gray levels. After calculating the contour noise degree with respect to each gray level by dividing by the optimally chosen threshold value in accordance with gray levels with respect to the sub-field arrays each, the order of priority was determined in the point of view of the contour noise.

As a result of comparing the order of priority of the contour noise of each gray level calculated by dividing by the optimally chosen threshold value in accordance with the gray level with the order of priority of the contour noise determined by human eye observation, these order of priority were almost identical.

Figure 27:
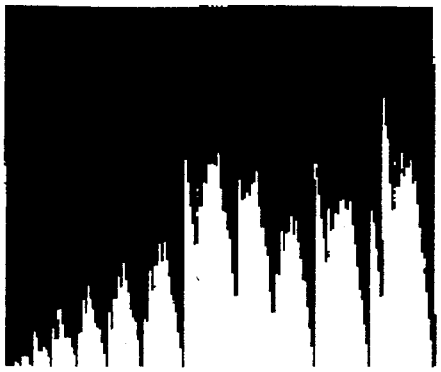
FIGS. 27 to 29 represent the result of an experiment when applying the gray level selecting method of a PDP to the sub-field arrays different from each other according to the embodiment of the present invention.
Figure 28:
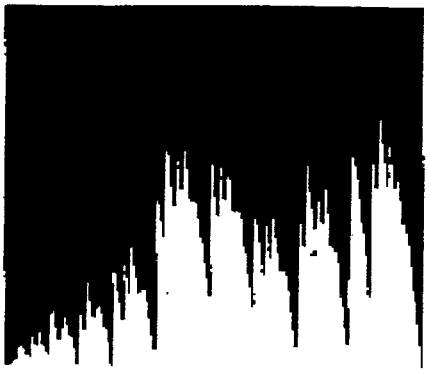
Figure 29:
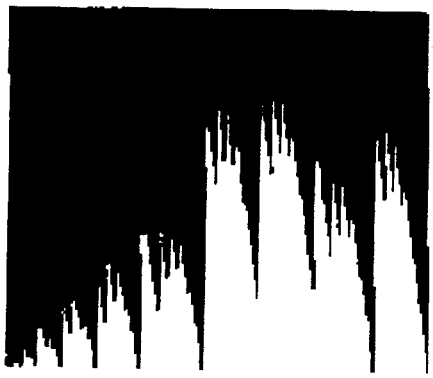

In this experimental result, even when the total numbers of gray levels are identical as '232', and the number of sub-fields vary such as '10', '11', '12' and etc., the contour noise degrees are observed similar, as in FIGS. 27 to 29.

There can be selected a sub-field array with its contour noise minimal in use of the optimally chosen threshold value in accordance with the gray level applied in the gray level selecting method according to the fourth embodiment of the present invention. To be more particular, firstly, the contour noise degree is calculated between each gray level of the sub-field arrays and the contour noise free gray level as in the contour noise measuring method of FIG. 12, secondly, the contour noise degree is divided by the optimally chosen threshold value in accordance with gray levels, lastly, the contour noise degrees divided by the threshold value are summed up. And then, the sub-field array that minimal is the sum of the contour noise degrees divided by the optimally chosen threshold value in accordance with the gray level is selected as a sub-field array with its contour noise minimal. In this way, if the contour noise degree is divided by the optimally chosen threshold value in accordance with the gray level, the contour noise degrees of all gray levels become to have identical or almost identical weighting values.

On the other hand, the optimal light-emission pattern generation method, the contour noise measuring method and the gray level selecting method according to the embodiments of the present invention can be implemented as programs for carrying out the algorithm of the foregoing flow chart needless of an additional composition of hardware.

As described above, the optimal light-emission pattern generation method of the PDP according to the present invention includes steps of calculating the contour noise degree between the contour noise free code and each gray level, selecting the optimal light-emission pattern with its contour noise minimal from the sub-field arrays to which the contour noise is given.

Also, the contour noise measuring method according to the present invention can rapidly select the sub-field array with its contour noise degree minimal from the given sub-field array and the light-emission pattern in use of the contour noise degree calculated between the contour noise free code and each gray level.

The gray level selecting method of the PDP according to the present invention selects only gray levels whose contour noise degree is not larger than the threshold value in application of the threshold value, and selects the gray levels considering the frequency of use in use of the histogram information, thereby being capable of selecting the gray level and the sub-field array whose contour noise degree is minimal.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A method of generating an optimal light-emission pattern for a plasma display panel, comprising steps of:

determining a plurality of light-emission patterns with respect to an arbitrary gray level;

calculating a contour noise degree between a contour noise free gray level being set in advance and the light-emission patterns given to each gray level in plurality; and selecting a light-emission pattern whose contour noise degree is minimal as a light-emission pattern with respect to an arbitrary gray level.

2. The method according to claim 1, wherein the contour noise degree is calculated by the sum of contour noise distance dCN defined as following equation:

$$dCN(Bi,Bj,SP)=|Bi-Bj|\square SP-|i-j|$$

Herein, Bi, Bj is light-emission pattern codes of gray level i and gray level j respectively, and SP is brightness weighting values of all sub-fields.

3. A method of measuring a contour noise of a plasma display panel, comprising steps of:

determining a plurality of sub-field arrays;

calculating a contour noise degree between a contour noise free gray level being set in advance and each gray level of the sub-field arrays;

summing up the contour noise degree of each gray level calculated; and selecting any one among the sub-field arrays in accordance with the sum of the contour noise degree.

4. The method according to claim 3, further comprising a step of:

selecting a sub-field array, the sum of whose contour noise degree is minimal, among sub-field arrays, the sum of whose contour noise degree is calculated.

5. The method according to claim 3, further comprising a step of:

after summing up the contour noise degree of each gray level calculated, calculating an average contour noise degree per gray level of the sub-field array by dividing the sum by the total number of gray levels.

6. The method according to claim 3, further comprising a step of:

after summing up the contour noise degree of each gray level calculated with respect to at least one sub-field array that has the total number of gray levels different from that of the sub-field arrays determined in the step of determining a plurality of sub-field arrays, calculating an average contour noise degree per gray level of the sub-field array by dividing the sum by the total number of gray levels.

7. The method according to claim 6, further comprising a step of:

selecting a sub-field array whose average contour noise degree per gray level is minimal among a plurality of sub-field arrays whose average contour noise degree per gray level is calculated.

8. The method according to claim 3, wherein the contour noise degree is calculated by the sum of contour noise distance dCN defined as following equation:

$$dCN(Bi,Bj,SP)=|Bi-Bj|\square SP-|i-j|$$

Herein, Bi, Bj is light-emission pattern codes of gray level i and gray level j respectively, and SP is brightness weighting values of all sub-fields.

9. A method of measuring a contour noise of a plasma display panel, comprising steps of:

determining a plurality of sub-field arrays to which brightness weighting values are given by sub-fields;

calculating a contour noise degree between a contour noise free gray level being set in advance and each gray level of the sub-field arrays;

dividing the contour noise degree by a threshold value set differently in a gray level scope that is not larger than a specific gray level value and a gray level scope that is not less than the specific gray level value;

summing up the contour noise degree divided by the threshold value; and selecting a sub-field array, the sum of whose contour noise degree is minimal.

10. The method according to claim 9, further comprising a step of:

after summing up the contour noise degree divided by the threshold value, calculating an average contour noise degree per gray level of the sub-field array by dividing the sum by the total number of gray levels.

11. The method according to claim 10, further comprising a step of:

selecting a sub-field array whose average contour noise degree per gray level is minimal among a plurality of sub-field arrays whose average contour noise degree per gray level is calculated.

12. A method of selecting a gray level for a plasma display panel, comprising steps of:

determining a sub-field array to which brightness weighting values are given by sub-fields;

calculating a contour noise degree between a contour noise free gray level being set in advance and each gray level of the sub-field array;

comparing the contour noise degree with a threshold value being set in advance, then selecting only gray levels whose contour noise degree is smaller than the threshold value; and displaying an image only with the selected gray level.

13. The method according to claim 12, wherein the contour noise degree is calculated by the sum of contour noise distance dCN defined as following equation:

$$dCN(Bi,Bj,SP)=|Bi-Bj|\square SP-|i-j|$$

Herein, Bi, Bj is light-emission pattern codes of gray level i and gray level j respectively, and SP is brightness weighting values of all sub-fields.

14. The method according to claim 12, wherein the threshold value is determined in accordance with at least any one of the amount of the contour noise degree and a gray level expression scope where it is possible to be displayed.

15. The method according to claim 12, further comprising a step of:

performing an error diffusion with respect to the gray level of the image for compensating a non-selected gray level that is bigger than the threshold value.

16. The method according to claim 12, wherein the threshold value is set differently in a low gray level that is not larger than a specific gray level value and in a high gray level that is not less than the specific gray level value.

17. The method according to claim 12, wherein the threshold value increases by a different gradient from each other respectively in a low gray level and a middle gray level that are not larger than a specific gray level value, and sustains a fixed value in a high gray level that is not less than the specific gray level value.

18. The method according to claim 12, wherein the threshold value increases linearly in a low gray level scope where the gray level is not larger than a specific gray level value, and sustains a fixed value in a high gray level scope where the gray level is not less than the specific gray level value.

19. A method of selecting a gray level for a plasma display panel, comprising steps of:

determining a plurality of sub-field arrays to which brightness weighting values are given;

calculating a contour noise degree between a contour noise free gray level being set in advance and each gray level of the sub-field arrays;

comparing the contour noise degree with the threshold value being set in advance, then selecting only gray levels whose contour noise degree is smaller than the threshold value; and selecting a sub-field array with its frequency of use maximal in reference of the frequency of use of the selected gray level.

20. A method of selecting a gray level for a plasma display panel, comprising steps of:

determining a plurality of sub-field arrays to which brightness weighting values are given;

calculating a contour noise degree between a contour noise free gray level being set in advance and each gray level of the sub-field arrays;

comparing the contour noise degree with the threshold value being set in advance, then selecting only gray levels whose contour noise degree is smaller than the threshold value and setting a gray level that is bigger than the threshold value as a non-selected gray level; and calculating the frequency of use of the non-selected gray level, and selecting a sub-field array with its frequency of use minimal.

* * * * *